US011163249B2

(12) United States Patent
Hashimura et al.

(10) Patent No.: US 11,163,249 B2
(45) Date of Patent: Nov. 2, 2021

(54) FIXING APPARATUS AND IMAGE FORMING APPARATUS

(71) Applicant: KONICA MINOLTA, INC., Tokyo (JP)

(72) Inventors: Yoshito Hashimura, Kawasaki (JP); Shimpei Kanamori, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/994,048

(22) Filed: Aug. 14, 2020

(65) Prior Publication Data

US 2021/0088945 A1 Mar. 25, 2021

(30) Foreign Application Priority Data

Sep. 20, 2019 (JP) ..... JP2019-171958

(51) Int. Cl.
*G03G 15/20* (2006.01)

(52) U.S. Cl.
CPC ..... *G03G 15/2032* (2013.01); *G03G 15/206* (2013.01); *G03G 15/2064* (2013.01)

(58) Field of Classification Search
CPC ..... G03G 15/2032; G03G 15/2035; G03G 15/2053
See application file for complete search history.

(56) References Cited

U.S. PATENT DOCUMENTS

| | | | | |
|---|---|---|---|---|
| 9,285,738 | B1 * | 3/2016 | Ukawa | G03G 15/2032 |
| 2011/0217100 | A1 * | 9/2011 | Yoshikawa | G03G 15/2064 399/342 |
| 2016/0010734 | A1 * | 1/2016 | Tokoro | B65H 3/0669 74/405 |
| 2018/0112762 | A1 * | 4/2018 | Nieda | F16H 53/02 |

FOREIGN PATENT DOCUMENTS

| | | | |
|---|---|---|---|
| JP | 2004077939 | A | 3/2004 |
| JP | 2014085654 | A * | 5/2014 |

* cited by examiner

*Primary Examiner* — Carla J Therrien
(74) *Attorney, Agent, or Firm* — Holtz, Holtz & Volek PC

(57) ABSTRACT

A fixing apparatus comprises: a fixing member and a pressing member; and a pressing mechanism that forms a fixing nip part by pressing the pressing member against the fixing member. The pressing mechanism has: a pressure cam to press the pressing member against the fixing member; a camshaft that the pressure cam is attached to, and that is rotated integrally with the pressure cam; a stepping motor; and a power transmission part that transmits a driving force of the stepping motor to the camshaft. The power transmission part includes a worm provided on a power transmission path from the stepping motor to the camshaft.

12 Claims, 16 Drawing Sheets

FIXING APPARATUS AND IMAGE FORMING APPARATUS

CROSS-REFERENCE TO RELATED APPLICATIONS

The entire disclosure of Japanese Patent Application Nos. 2019-171958 and 2019-171959, filed on Sep. 20, 2019, is incorporated herein by reference in its entirety.

BACKGROUND

Technological Field

The present invention relates to a fixing apparatus and an image forming apparatus having the fixing apparatus.

Description of the Related Art

In an electrophotographic image forming apparatus, an image is formed on paper through respective processes of charging, exposure, development, transfer, and fixing. In the fixing process, a fixing apparatus having a fixing member and a pressing member is used. In the fixing apparatus, the pressing member is pressed against the fixing member to form a fixing nip part, and the paper is made to pass through the fixing nip part, thus a toner image is fixed on the paper. As an image forming apparatus having this type of fixing apparatus, an apparatus having a pressing mechanism capable of switching a press-fixed status of pressing the pressing member against the fixing member to press-fix the both members and a released status of moving the pressing member from the fixing member to release the press-fixing between the both members, by rotation of a pressure cam, is known.

Japanese Patent Application Laid-Open No. 2004-77939 (Patent Literature 1) discloses a fixing apparatus, having the above-described pressing mechanism, in an image forming apparatus. In the fixing apparatus, when a bearing to regulate the height of the pressing member is brought into contact with the pressure cam, the pressure cam is positioned at a bottom dead center, and the pressing member is moved away from the fixing member. When the pressure cam is positioned at a top dead center, the pressing member is pressed against the fixing member. In the fixing apparatus disclosed in Patent Literature 1, the pressure cam is attached to a pressure shaft, and is moved, along with the pressure shaft, in the axial direction. Further, the pressure cam is provided with different-height three step parts, such that the height of the pressing member can be changed by arbitrarily moving the pressure cam and the pressure shaft in the axial direction to bring the bearing into contact with any one of the three step parts. When the height of the pressing member is changed, the pressing force (pressurizing force) of the pressing member against the fixing member is changed. Further, when the pressing force of the pressing member is changed, the nip pressure caused in the fixing nip part is changed. Accordingly, in the fixing apparatus disclosed in Patent Literature 1, it is possible to switch the nip pressure among three steps by utilizing the three steps provided in the pressure cam.

CITATION LIST

Patent Literature

Patent Literature 1

Japanese Patent Application Laid-Open No. 2004-77939

SUMMARY

In the fixing apparatus disclosed in Patent Literature 1, the status between the fixing member and the pressing member is switched between the press-fixed status and the released status by rotation of the pressure cam. As the position of the rotating pressure cam, there are only two positions, i.e., the top dead center to obtain the press-fixed status and the bottom dead center to obtain the released status. Further, each time the nip pressure of the fixing nip part is switched, it is necessary to change the nip pressure in the following procedure each time. First, the pressure cam is rotated to the bottom dead center, to release the press-fixed status between the fixing member and the pressing member. Next, the pressure cam and the pressure shaft are moved in the axial direction such that the bearing becomes into contact with desired one of the above-described three step parts. Next, the pressure cam is rotated to the top dead center to restore the fixing member and the pressing member to the press-fixed status. In the fixing apparatus disclosed in Patent Literature 1, each time the nip pressure of the fixing nip part is switched, it is necessary to go through this troublesome procedure.

The present invention has been made to solve the above problems, and to provide a fixing apparatus and an image forming apparatus capable of switching nip pressure of a fixing nip part among multiple nip pressures by utilizing rotation of a pressure cam without any troublesome procedure.

To achieve at least one of the abovementioned objects, a fixing apparatus reflecting one aspect of the present invention comprises: a fixing member and a pressing member; and a pressing mechanism that forms a fixing nip part by pressing the pressing member against the fixing member. The pressing mechanism has: a pressure cam to press the pressing member against the fixing member; a camshaft that the pressure cam is attached to, and that is rotated integrally with the pressure cam; a stepping motor; and a power transmission part that transmits a driving force of the stepping motor to the camshaft. The power transmission part includes a worm provided on a power transmission path from the stepping motor to the camshaft. Further, an image forming apparatus reflecting another aspect of the present invention has the fixing apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

<Configuration of Image Forming Apparatus>

Figure 1:
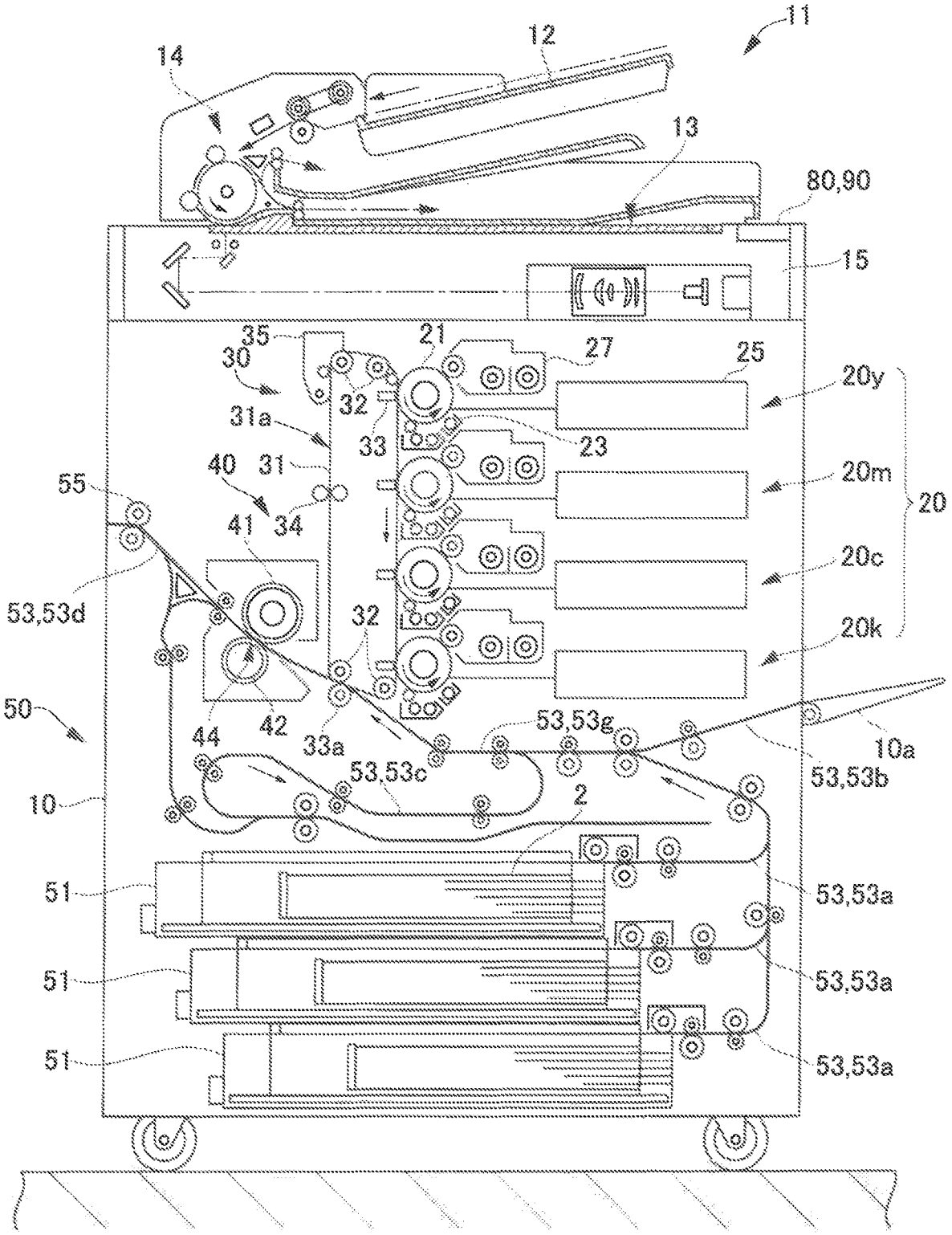
FIG. 1 is a schematic cross-sectional view showing the entire configuration of an image forming apparatus according to a first embodiment of the present invention.

FIG. 1 is a schematic cross-sectional view showing the entire configuration of an image forming apparatus according to a first embodiment of the present invention.

As shown in FIG. 1, an image forming apparatus 1 is an electrophotographic image forming apparatus to perform image formation with respect to a recording medium 2. The recording medium 2 handled in the image forming apparatus 1 includes various types of media such as plain paper, cardboard, thin paper, and envelopes.

The image forming apparatus 1 is provided with an image reading part 11 on a housing 10 as an apparatus main body. The image forming apparatus 1 is provided with an image forming part 20, a transfer part 30, a fixing apparatus 40, and a recording medium supply part 50, inside the housing 10. Further, the image forming apparatus 1 is provided with an operation unit 80 and a display unit 90.

(Image Reading Part)

The image reading part 11 is provided with an original receiving tray 12, an original platen 13, an automatic document feeding mechanism 14, and an imaging unit 15. The automatic document feeding mechanism 14 feeds an original placed on the original receiving tray 12 sequentially to the original platen 13. The image reading part 11 reads an image of an original directly placed on the original platen 13, or an image of the original fed with the automatic document feeding mechanism 14 to the original platen 13, with the imaging unit 15, to generate image data. Note that in the present embodiment, image data as the object of print job is not only the image data read with the imaging unit 15 but also may be image data received from an external device such as a personal computer connected to the image forming apparatus 1 or another image forming apparatus.

(Image Forming Part)

The image forming part 20 has four image forming units 20*y*, 20*m*, 20*c*, and 20*k* to form yellow (Y), magenta (M), cyan (C), and black (K) color toner images. The image forming unit 20*y* is provided with a photoreceptor 21, a charger 23, an exposure device 25, and a developer 27. The other image forming units 20*m*, 20*c*, and 20*k* respectively have the photoreceptor 21, the charger 23, the exposure device 25, and the developer 27.

The photoreceptor 21 is an image carrier on which a toner image is formed. The photoreceptor 21 is formed in a drum shape. The photoreceptor 21 is rotated in accordance with driving of an unshown photoreceptor driving motor. The charger 23, the exposure device 25, and the developer 27 are provided in order, from the upstream side toward the downstream side in the rotation direction of the photoreceptor 21, around the photoreceptor 21.

The outer peripheral surface of the photoreceptor 21 is an image carrier surface. The image carrier surface of the photoreceptor 21 is uniformly charged with the charger 23. Then an electrostatic latent image is formed by exposure scanning with the exposure device 25 on the charged image carrier surface. The exposure scanning with the exposure device 25 is performed based on the image data read with the image reading part 11 or the image data received from the external device.

The developer 27 supplies toner to the image carrier surface of the photoreceptor 21 where the electrostatic latent image is formed, to attach the toner to the electrostatic latent image. With this operation, a yellow toner image is formed on the image carrier surface of the photoreceptor 21 of the image forming unit 20*y*. Further, a magenta toner image is formed on the image carrier surface of the photoreceptor 21 of the image forming unit 20*m*, a cyan toner image is formed on the image carrier surface of the photoreceptor 21 of the image forming unit 20*c*, and a black toner image is formed on the image carrier surface of the photoreceptor 21 of the image forming unit 20*k*.

(Transfer Part)

The transfer part 30 is provided in parallel to the image forming part 20. The transfer part 30 is provided with an intermediate transfer belt 31 as a rotating endless belt, multiple belt support rollers 32 inscribed in the intermediate transfer belt 31, and a primary transfer unit 33. Further, the transfer part 30 is provided with a secondary transfer roller 33*a*, destaticizing rollers 34, and a cleaning unit 35.

The intermediate transfer belt 31 is provided in a loop shape in a status where it is put around the multiple belt support rollers 32. The outer peripheral surface of the intermediate transfer belt 31 is used as an image carrier surface 31*a*. The image carrier surface 31*a* of the intermediate transfer belt 31 is provided in contact with the respective photoreceptors 21 of the image forming units 20*y*, 20*m*, 20*c*, and 20*k*. The intermediate transfer belt 31 is rotated in an opposite direction to the rotation of the respective photoreceptors 21 of the image forming units 20*y*, 20*m*, 20*c*, and 20*k*.

The multiple belt support rollers 32 are provided on the inner peripheral side of the intermediate transfer belt 31 such that the image carrier surface 31*a* of the intermediate transfer belt 31 is in contact with all the four photoreceptors 21 corresponding to the four image forming units 20*y*, 20*m*, 20*c*, and 20*k*. One of the multiple belt support rollers 32 is configured as a belt driving roller to rotate the intermediate transfer belt 31.

The primary transfer unit 33 is provided in positions respectively opposite to the four photoreceptors 21. Each primary transfer unit 33 is provided on the inner peripheral side of the intermediate transfer belt 31, and provided so as to hold the intermediate transfer belt 31 between the primary transfer unit 33 and the corresponding photoreceptor 21. The primary transfer unit 33 transfers toner attached on the image carrier surface of the photoreceptor 21 onto the image carrier surface 31*a* of the intermediate transfer belt 31 by applying an electrical charge having a polarity opposite to that of the toner to the intermediate transfer belt 31.

The secondary transfer roller 33*a* transfers the toner image, transferred onto the image carrier surface 31*a* of the intermediate transfer belt 31, to the recording medium 2. The secondary transfer roller 33*a* is provided oppositely to one of the above-described multiple belt support rollers 32. The secondary transfer roller 33*a* is provided so as to hold the intermediate transfer belt 31 between the secondary transfer roller 33*a* and the belt support roller 32. The position in which the secondary transfer roller 33*a* and the belt support roller 32 are in contact with each other is a transfer position when the toner image, transferred onto the image carrier surface 31*a* of the intermediate transfer belt 31, is transferred to the recording medium 2.

The destaticizing rollers 34 are provided on the upstream side of the primary transfer unit 33 opposite to the photoreceptor 21 of the image forming unit 20*y* and on the downstream side of the secondary transfer roller 33*a* in the rotation direction of the intermediate transfer belt 31. The destaticizing rollers 34 are configured with a pair of rollers to hold the intermediate transfer belt 31, to destaticize the electrical charge of the intermediate transfer belt 31.

The cleaning unit 35 is provided on the upstream side of the primary transfer unit 33 opposite to the photoreceptor 21 of the image forming unit 20*y* and on the downstream side of the destaticizing rollers 34 in the rotation direction of the intermediate transfer belt 31. The cleaning unit 35 is provided oppositely to the image carrier surface 31*a*, to remove remaining toner from the image carrier surface 31*a* of the intermediate transfer belt 31.

(Fixing Apparatus)

The fixing apparatus 40 is provided with a fixing roller 41 as a fixing member and a pressure roller 42 as a pressing member. The fixing roller 41 includes an unshown heater. The pressure roller 42 is pressed against the fixing roller 41 with a pressing mechanism 45 (see FIG. 3) to be described later. With this configuration, the fixing roller 41 and the pressure roller 42 are press-fixed to each other, and a fixing nip part 44 is formed in this press-fixed part. The recording medium 2 is heated and pressurized when it is made to pass through the fixing nip part 44, and with the heating and pressurization, the toner image is fixed to the recording medium 2. The nip pressure of the fixing nip part 44 is increased in accordance with increase of pressurizing force (pressing force) when the pressure roller 42 is pressed against the fixing roller 41. Further, the nip width of the fixing nip part 44 is increased in accordance with increase of the nip pressure. An appropriate value of the nip pressure differs in accordance with type of the recording medium 2. For example, when a comparison is made between plain paper and thin paper as the recording medium 2, the nip pressure appropriate value of the plain paper is higher than that of the thin paper. Accordingly, it is preferable to perform control to switch the nip pressure in accordance with type of the recording medium 2.

Note that in the present embodiment, the fixing apparatus 40 is a two-roller type apparatus having the fixing roller 41 and the pressure roller 42. However, the present invention is not limited to this example. For example, although not shown, a fixing apparatus in which a fixing belt is put around the fixing roller and another roller, i.e., a three-roller type fixing apparatus, may be employed. When the three-roller type fixing apparatus is used, the recording medium 2 is nipped between the fixing belt put around the fixing roller and the pressure roller.

(Recording Medium Supply Part)

The recording medium supply part 50 is provided with multiple supply trays 51 and a conveyance passage 53 for conveying the recording medium 2. The multiple supply trays 51 are provided in a lower part of the housing 10 for separately accommodating the recording media 2 in different sizes and of different types. The respective supply trays 51 supply the recording media 2 accommodated in the tray to the conveyance passage 53 one by one.

The conveyance passage 53 is provided with individual conveyance passages 53*a* to convey the recording media 2 supplied from the respective supply trays 51 to the secondary transfer roller 33*a* one by one. Further, the image forming apparatus 1 is provided with a manual-feed tray 10*a* outside of the housing 10. The conveyance passage 53 is provided with a manual-feed conveyance passage 53*b* extended from the manual-feed tray 10*a*. The recording medium 2 supplied form the manual-feed tray 10*a* is conveyed through the manual-feed conveyance passage 53*b* to the secondary transfer roller 33*a*. Further, the conveyance passage 53 is provided with a turn-over conveyance passage 53*c* to turn the recording medium 2 passing through the fixing apparatus 40 over and supply the recording medium 2 again to the secondary transfer roller 33*a* and a discharge conveyance passage 53*d* to discharge the recording medium 2 having passed through the fixing apparatus 40.

The above-described individual conveyance passage 53*a*, the manual-feed conveyance passage 53*b*, and the turn-over conveyance passage 53*c* join as one confluent conveyance passage 53*g* on the upstream side of the secondary transfer roller 33*a*. Accordingly, the recording media 2 supplied from the respective supply trays 51, the recording medium 2 supplied from the manual-feed tray 10*a*, and the recording medium 2 supplied from the turn-over conveyance passage 53*c* are supplied through the confluent conveyance passage 53*g* to the secondary transfer roller 33*a*. On the other hand, the discharge conveyance passage 53*d* is a conveyance passage to convey the recording medium 2 having passed through the fixing apparatus 40 to a discharge roller 55. The discharge roller 55 is a roller to discharge the recording medium 2 after image formation to a discharge tray or the like.

(Operation Unit)

The operation unit 80 is used for inputting various settings and conditions related to image formation. The operation unit 80 may be, e.g., operation keys provided on an upper surface part of the housing 10 or a touch panel provided on the display surface of the display unit 90. Further, the operation unit 80 may be provided in the external device connected to the image forming apparatus 1 such as a personal computer. Upon implementation of a print job in the image forming apparatus 1, the image forming conditions set with the operation unit 80 include information on the type of the recording medium 2. The type of the recording medium 2 includes e.g. plain paper, cardboard, thin paper, and envelopes.

(Display Unit)

The display unit 90 is used for display of the various settings and conditions related to image formation. The display unit 90 is configured with e.g. a thin-type display provided on the upper surface part of the housing 10. The display unit 90 may be provided with a touch panel as the operation unit 80 on the display surface. Further, the display unit 90 may be provided in the external device connected to the image forming apparatus 1 such as a personal computer.

Next, the configuration of the fixing apparatus according to the first embodiment of the present invention will be described in detail.

Figure 2:
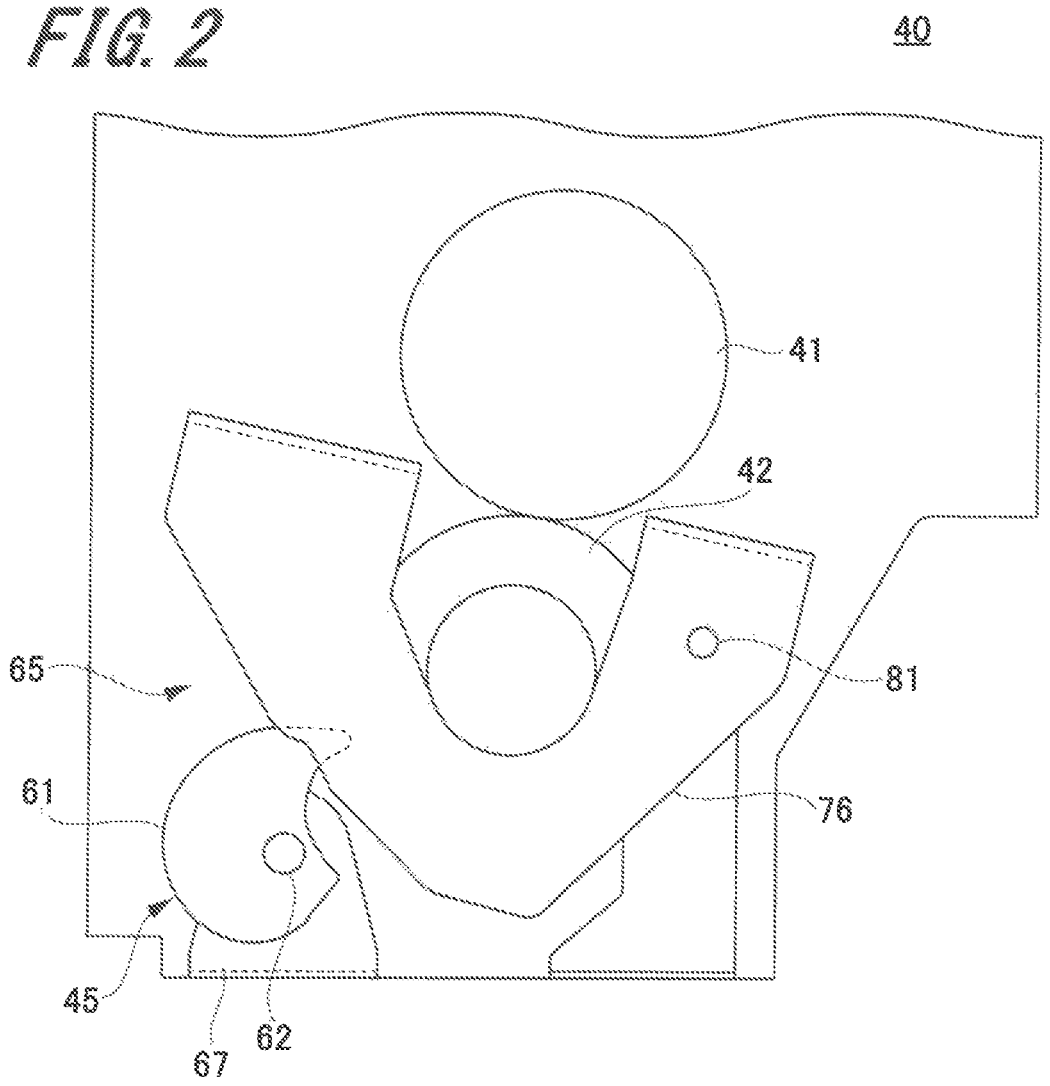
FIG. 2 is a cross-sectional view showing the configuration of peripheral part of a pressing mechanism as a main part of a fixing apparatus according to the first embodiment of the present invention.
Figure 3:
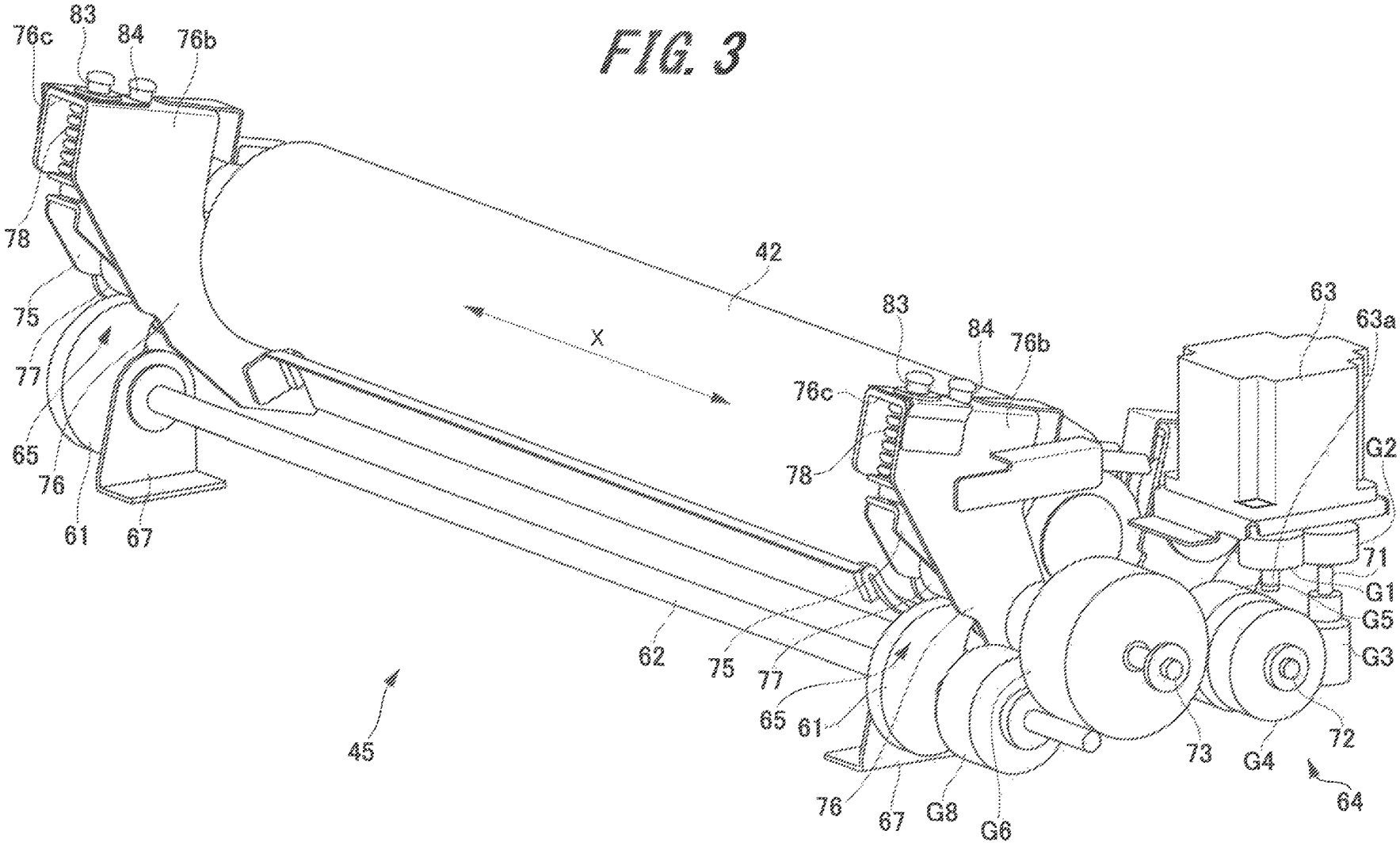
FIG. 3 is a perspective view showing the configuration of the pressing mechanism shown in FIG. 2.
Figure 4:
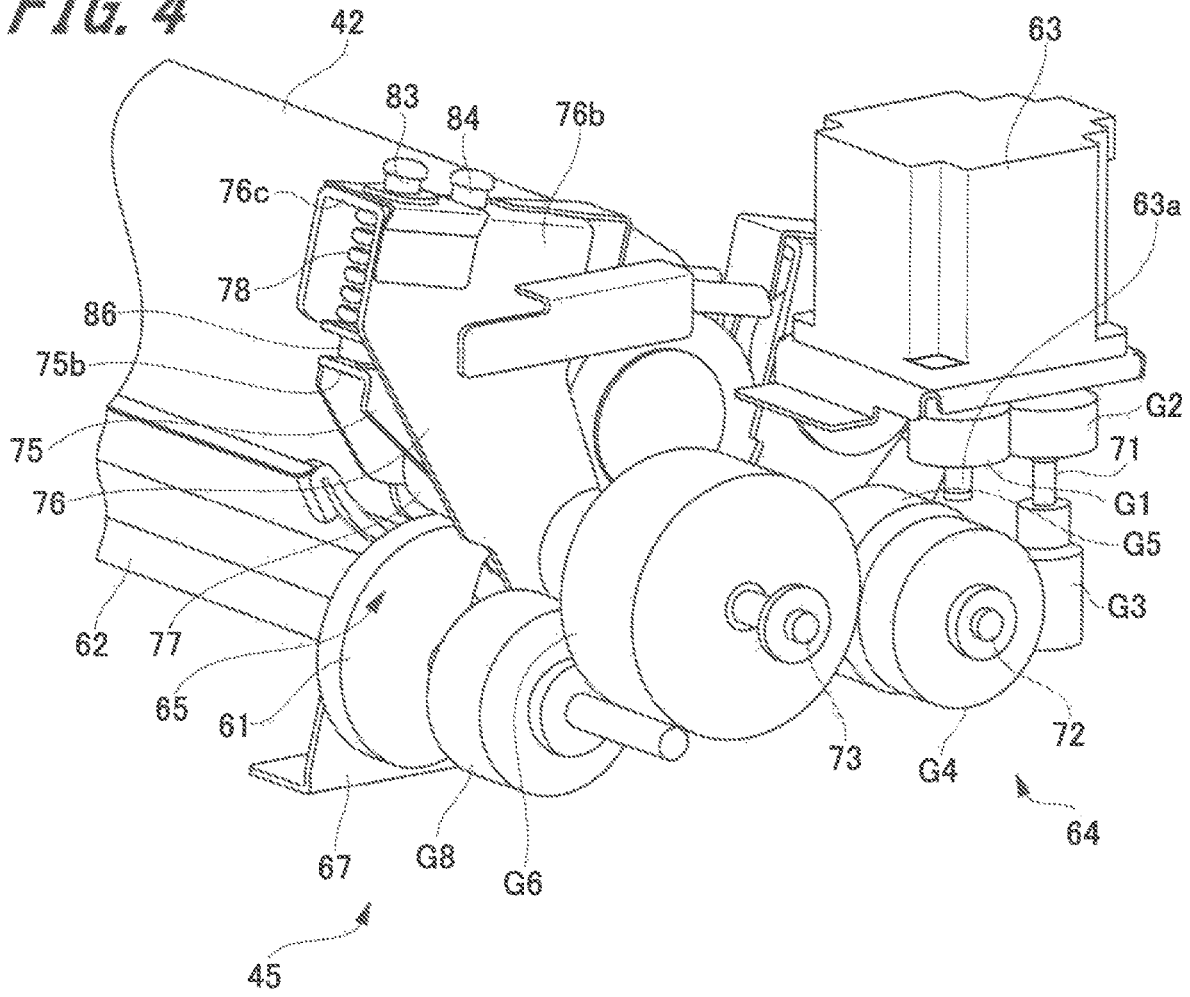
FIG. 4 is an enlarged perspective view of a part of the pressing mechanism shown in FIG. 3.
Figure 5:
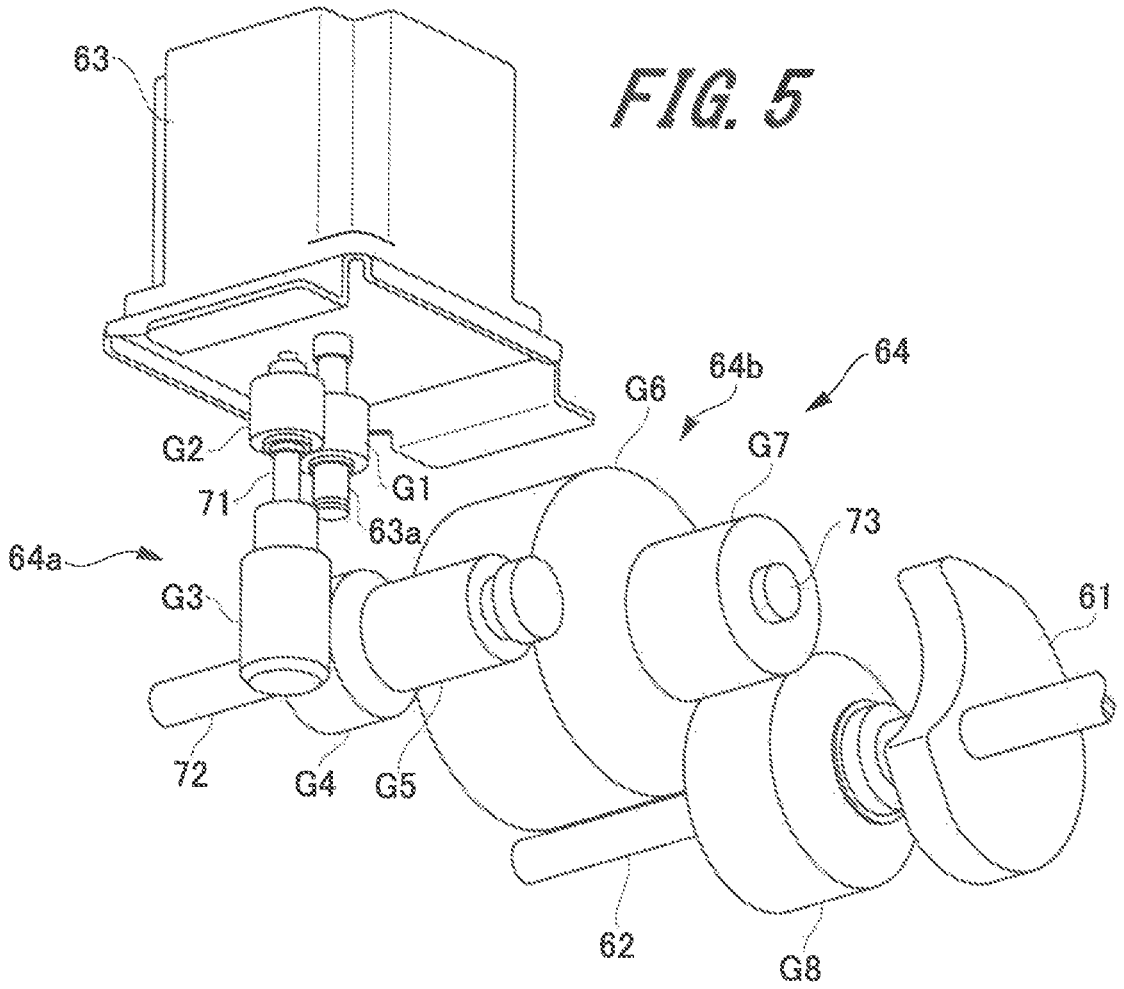
FIG. 5 is a perspective view showing the pressing mechanism shown in FIG. 4 viewed from another direction.

FIG. 2 is a cross-sectional view showing the configuration of peripheral part of the pressing mechanism as a main part of the fixing apparatus according to the first embodiment. FIG. 3 is a perspective view showing the configuration of the pressing mechanism shown in FIG. 2. Further, FIG. 4 is an enlarged perspective view of a part of the pressing mechanism shown in FIG. 3. FIG. 5 is a perspective view showing the pressing mechanism shown in FIG. 4 viewed from another direction.

As shown in FIG. 2 to FIG. 5, the pressing mechanism 45 is a mechanism to press the pressure roller 42 against the fixing roller 41 to form a fixing nip. The pressing mechanism 45 is provided with a pressure cam 61 to press the pressure roller 42 against the fixing roller 41, a cam shaft 62 to which the pressure cam 61 is attached, a stepping motor 63 as a driving source of the pressing mechanism 45, a power transmission part 64 to transmit the driving force of the stepping motor 63 to the cam shaft 62, and a roller support part 65 to receive and support the roller shaft at both ends of the pressure roller 42 from the lower side.

(Pressure Cam)

As shown in FIG. 3, the pressure cam 61 is provided on one end side and on the other end side, in the central axis direction X of the pressure roller 42. The respective pressure cams 61 are arranged in the same direction (attitude) in the direction around the center axis of the cam shaft 62. The pressure cam 61 is rotated integrally with the cam shaft 62, to press the pressure roller 42 against the fixing roller 41, and to move the pressure roller 42 away from the fixing roller 41. Accordingly, with the rotation of the pressure cam 61, it is possible to press-fix the fixing roller 41 and the pressure roller 42 or to release the press-fixed status.

Next, the shape of the pressure cam 61 will be described in detail by using FIG. 6 and FIG. 7.

Figure 6:
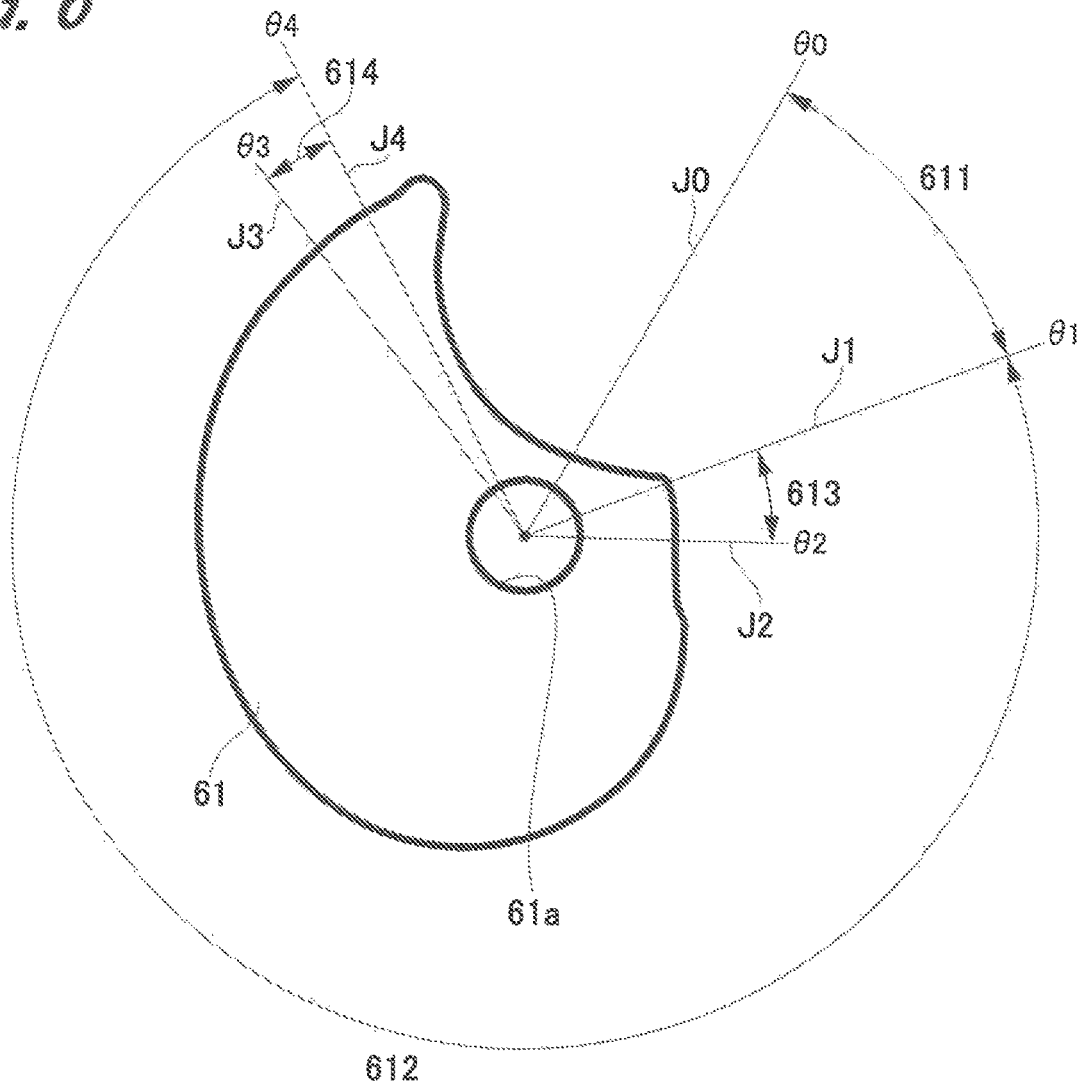
FIG. 6 is a schematic diagram showing the shape of a pressure cam.

FIG. 6 is a schematic diagram showing the shape of the pressure cam 61. FIG. 7 is a cam curve diagram of the pressure cam 61. FIG. 6 shows the shape of the pressure cam 61 viewed from the central axis direction of the cam shaft 62. In the cam curve diagram shown in FIG. 7, the vertical axis indicates the cam height of the pressure cam 61, and the lateral axis indicates the rotation angle of the pressure cam 61. The cam height represents a distance from the rotation center of the pressure cam 61 to the cam surface. The cam height at the bottom dead center, where the cam height is minimum, is denoted by H1, and the cam height at the top dead center, where the cam height is maximum, is denoted by H3. In the following description, the distance from the rotation center of the pressure cam 61 to the cam surface is also referred to as "cam height". The rotation angle of the pressure cam 61 represents the angle (attitude) of the pressure cam 61 in the rotation direction. The minimum rotation angle is denoted by θ0, and the maximum rotation angle is denoted by θ4. The rotation angle of the pressure cam 61 at the bottom dead center where the cam height is minimum is θ0, i.e., the minimum rotation angle. The rotation angle of the pressure cam 61 at the top dead center where the cam height is maximum is θ4, i.e., the maximum rotation angle. Accordingly, it is possible to adjust the rotation angle of the pressure cam 61 within the range from the minimum rotation angle θ0 to the maximum rotation angle θ4. Here, as an example, the minimum rotation angle θ0 of the pressure cam 61 is 0°, and the maximum rotation angle θ4 of the pressure cam 61 is 316°.

Figure 7:
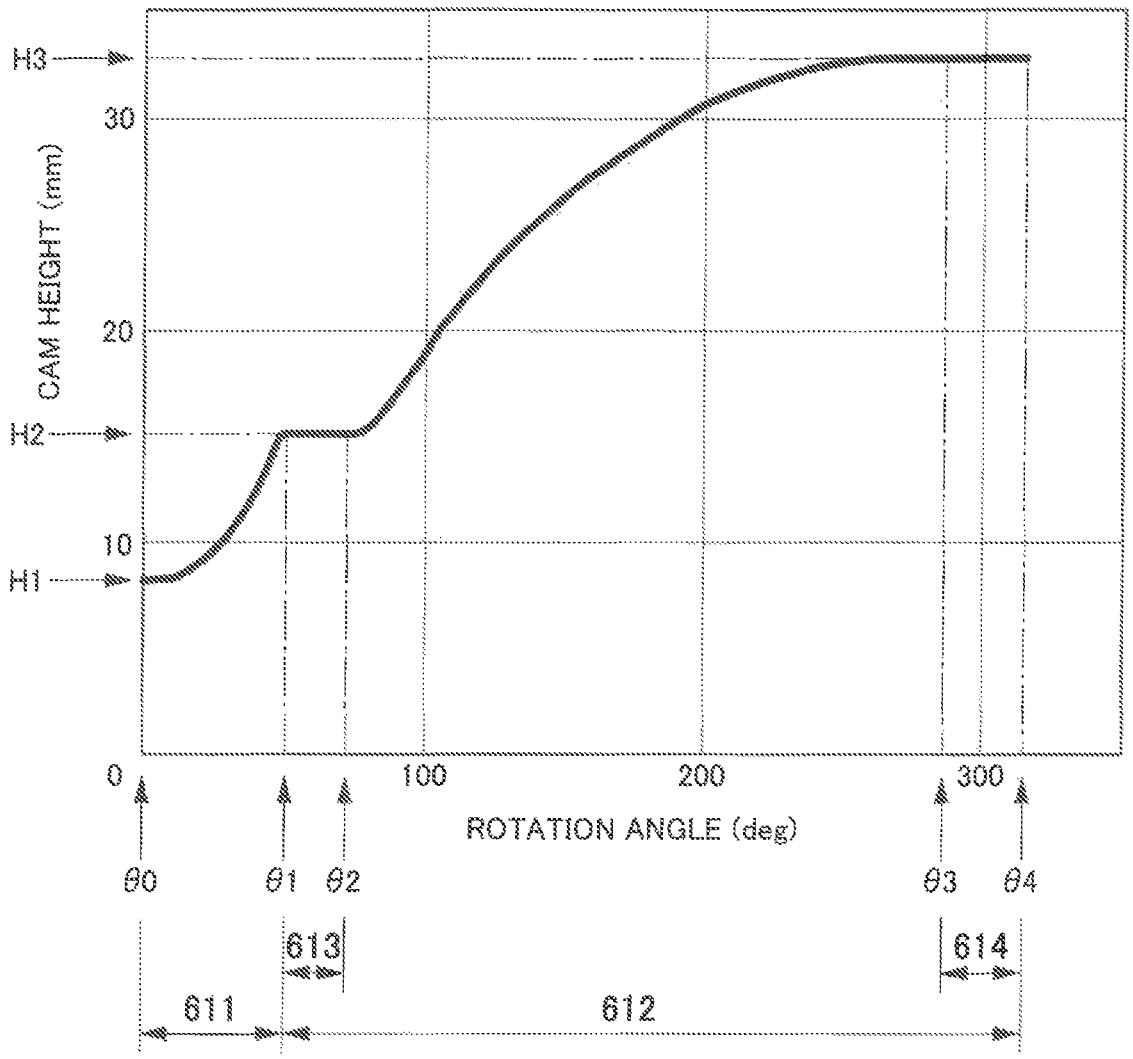
FIG. 7 is a cam curve diagram of the pressure cam.

As shown in FIG. 6 and FIG. 7, a first cam surface region 611 and a second cam surface region 612 exist on the cam surface (outer peripheral surface) of the pressure cam 61. The first cam surface region 611 and the second cam surface region 612 are positioned in cam surface regions mutually different in the rotation direction of the pressure cam 61. The first cam surface region 611 is a cam surface region where the cam height changes more steeply than in the second cam surface region 612. The second cam surface region 612 is a cam surface region where the cam height changes more gently than in the first cam surface region 611.

The first cam surface region 611 is a cam surface region to press the pressure roller 42 against the fixing roller 41 and press-fix them by rotation of the pressure cam 61 from a status where the pressure roller 42 is away from the fixing roller 41. When the range of the first cam surface region 611 is defined by angle of the pressure cam 61 in the rotation direction, it is θ0 or larger and smaller than θ4. The second cam surface region 612 is a cam surface region to change the nip pressure of the fixing nip part 44 formed by press-fixing between the fixing roller 41 and the pressure roller 42. When the range of the second cam surface region 612 is defined by angle of the pressure cam 61 in the rotation direction, it is θ1 or larger and θ4 or smaller.

The second cam surface region 612 is provided with two cam flat parts 613 and 614 corresponding to a third cam surface region where the cam height is uniform. The cam flat part 613 is provided on one end side of the second cam surface region 612. The cam flat part 614 is provided on the other end side of the second cam surface region 612. The cam height of the cam flat part 613, denoted by H2, is constant, and the cam height of the cam flat part 614, denoted by H3, is constant. When the range of the cam flat part 613 is defined by rotation angle of the pressure cam 61, it is θ1 or larger and smaller than θ2. When the range of the cam flat part 614 is defined by rotation angle of the pressure cam 61, it is θ3 or larger and θ4 or smaller. As the relation of the rotation angles θ0, θ1, θ2, θ3, and θ4 of the pressure cam 61, θ0<θ1<θ2<θ3<θ4 holds. For example, θ0=0°, θ1=51°, θ2=73°, θ3=286°, and θ4=316° hold.

When the pressure cam 61 having this cam shape is employed, as the cam height of the first cam surface region 611 steeply changes, by utilizing the steepness, it is possible to quickly press-fix the fixing roller 41 and the pressure roller 42. It is possible to improve the responsiveness till the formation of the fixing nip part 44. Further, it is possible to suppress the amount of rotation of the pressure cam 61 necessary for press-fixing of the fixing roller 41 and the pressure roller 42 to a small value. Accordingly, it is advantageous in downsizing of the pressure cam 61. On the other hand, as the cam height of the second cam surface region 612 gently changes, when the nip pressure is increased from the status where the fixing roller 41 and the pressure roller 42 are press-fixed, by the gentle change of the cam height, it is possible to suppress sudden increase of the nip pressure. With this configuration, the nip pressure is increased without application of sudden load to the respective parts of the pressing mechanism 45. Accordingly, it is possible to suppress deformation, breakage, or the like of the pressing mechanism 45.

Note that in the present embodiment, the second cam surface region 612 is provided with the two cam flat parts 613 and 614, however, the present invention is not limited to this arrangement. The cam flat parts may be provided only one side of the second cam surface region 612, or may be provided in the intermediate part of the second cam surface region 612. Further, three or more cam flat parts may be provided.

(Cam Shaft)

Returning to FIG. 3 to FIG. 5, the cam shaft 62 is provided in parallel to the central axis direction X of the pressure roller 42. The cam shaft 62 is configured with e.g. a metal round shaft. The cam shaft 62 is rotatably supported with a pair of support members 67. The above-described pressure cam 61 is provided with a cam hole 61*a* (see FIG. 6) with a bore diameter corresponding to the diameter of the cam shaft 62. The pressure cam 61 is attached to the cam shaft 62 by inserting the cam shaft 62 into the cam hole 61*a*. Further, the pressure cam 61 is fixed, so as to be rotated integrally with the cam shaft 62, to the cam shaft 62.

(Stepping Motor)

The stepping motor 63 is provided on one end side of the pressure roller 42 in the central axis direction X. The stepping motor 63 performs rotary driving in accordance with an input pulse (pulse signal) supplied from a controller 91 (see FIG. 12) to be described later to the stepping motor 63. At this time, it is possible to control the rotation direction of the stepping motor 63 with the order of the input pulses, and it is possible to control the rotation amount of the stepping motor 63 with the number of input pulses (the number of steps). The rotation amount of the stepping motor 63 is increased in accordance with increase of the number of input pulses supplied to the stepping motor 63.

(Power Transmission Part)

The power transmission part 64 is configured with multiple gears G1 to G8. In the present embodiment, as an example, eight gears G1 to G8 are used. The eight gears G1 to G8 are provided on a power transmission path from the stepping motor 63 to the cam shaft 62. The gear G1 is a spur gear attached to a driving shaft 63*a* of the stepping motor 63. The gear G1 is rotated integrally with the driving shaft 63*a* of the stepping motor 63. The gear G2 is a spur gear attached to a first gear shaft 71. The first gear shaft 71 is provided in parallel to the driving shaft 63*a* of the stepping motor 63. The gear G2 is engaged with the gear G1. The gear G3 is a worm attached to the first gear shaft 71 as in the case of the gear G2. The gear G2 and the gear G3 are rotated integrally with the first gear shaft 71.

The gear G4 is a worm wheel attached to a second gear shaft 72. The second gear shaft 72 is provided in a direction orthogonal to the first gear shaft 71. The gear G4 is rotated integrally with the second gear shaft 72. The gear G4 as a worm wheel is engaged with the gear G3 as a worm. The combination of these two gears G3 and G4 forms a worm gear. The gear G5 is a spur gear attached to the second gear shaft 72 as in the case of the gear G4. The gear G5 is rotated integrally with the second gear shaft 72.

The gear G6 is a spur gear attached to a third gear shaft 73. The third gear shaft 73 is provided in parallel to the second gear shaft 72 and the cam shaft 62. The gear G6 is rotated integrally with the third gear shaft 73. The gear G6 is engaged with the gear G5. The gear G7 is a spur gear attached to the third gear shaft 73 as in the case of the gear G6. The gear G7 is a spur gear having a diameter smaller than that of the gear G6. The gear G7 is rotated integrally with the third gear shaft 73. The gear G8 is a spur gear attached to the cam shaft 62. The gear G8 is rotated integrally with the cam shaft 62. The gear G8 is engaged with the gear G7. Further, the gear G8 is provided closer to the shaft end of the cam shaft 62 than the pressure cam 61 in the central axis direction X of the pressure roller 42.

In the power transmission part 64 having the above configuration, the driving force of the stepping motor 63 is transmitted as follows. First, when the stepping motor 63 starts driving, the driving force of the stepping motor 63 is transmitted from the gear G1 to the gear G2. At this time, the gear G1 and the gear G2 are rotated in mutually opposite directions. The first gear shaft 71 is rotated in an opposite direction to that of the driving shaft 63*a* of the stepping motor 63. In this manner, when the first gear shaft 71 is rotated, the gear G3 is rotated integrally with the first gear shaft 71. Then the rotation force of the gear G3 is transmitted to the gear G4. The second gear shaft 72 is rotated in accordance with the rotation direction of the first gear shaft 71.

Further, when the second gear shaft 72 is rotated as described above, the gear G5 is rotated integrally with the second gear shaft 72. Then the rotation force of the gear G5 is transmitted to the gear G6. At this time, the gear G5 and the gear G6 are rotated in mutually opposite directions. The third gear shaft 73 is rotated in an opposite direction to that of the second gear shaft 72. In this manner, when the third gear shaft 73 is rotated, the gear G7 is rotated integrally with the third gear shaft 73. Then the rotation force of the gear G7 is transmitted to the gear G8. At this time, the gear G7 and the gear G8 are rotated in mutually opposite directions. The cam shaft 62 is rotated in an opposite direction to that of the third gear shaft 73. Further, when the cam shaft 62 is rotated, the pressure cam 61 is rotated integrally with the cam shaft 62. With the power transmission as described above, it is possible to rotate the pressure cam 61 with the stepping motor 63 as a driving source.

Note that in the configuration of the power transmission part 64, as shown in FIG. 5, the power transmission mechanism from the gear G1 to the gear G3 is referred to as an upstream-side power transmission mechanism 64*a*, and the power transmission mechanism from the gear G4 to the gear G8 is referred to as a downstream-side power transmission mechanism 64*b*. In this case, the upstream-side power transmission mechanism 64*a* is configured with a power transmission mechanism where no force occurs in a thrust direction with respect to the driving shaft 63*a* of the stepping motor 63. More specifically, the upstream-side power transmission mechanism 64*a* is configured with a gear transmission mechanism using the two spur gears, the gear G1 and the gear G2. When the driving force of the stepping motor 63 is transmitted to the gear G3 as a worm, as the driving force is transmitted by engagement between the spur gears (G4 and G5), the force in the thrust direction (thrust load) is not applied to the driving shaft 63*a* of the stepping motor 63. When the stepping motor 63 is used as a driving source of the pressing mechanism 45, it is possible to select a small motor. On the other hand, when a force in the thrust direction is applied to the driving shaft 63*a* of the stepping motor 63, it is necessary to select a large motor so as to obtain a stable driving force even when the force in the thrust direction is received. Accordingly, by configuring the upstream-side power transmission mechanism 64*a* with a power transmission mechanism where no force occurs in the thrust direction with respect to the driving shaft 63*a* of the stepping motor 63 as described above, it is possible to select a small motor, and contribute to downsizing of the fixing apparatus 40.

(Roller Support Member)

The roller support part 65 is provided on the one end side and the other end side of the pressure roller 42 in the central axis direction X as in the case of the pressure cam 61. The roller support part 65 is provided with a first arm member 75, a second arm member 76, a cam follower 77, and two springs 78 and 79 as elastic members. Note that as an elastic member, other member than the spring may be used.

Figure 8:
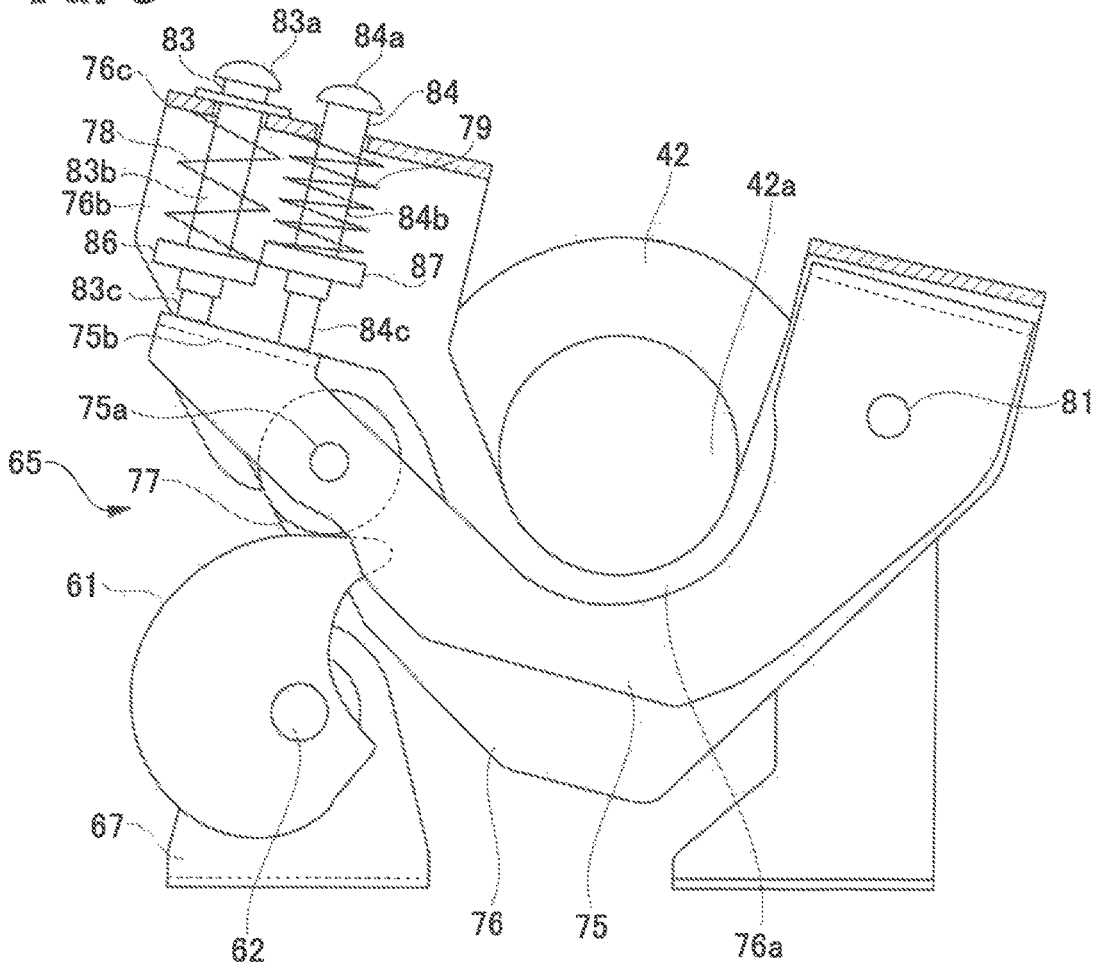
FIG. 8 is a schematic diagram showing the configuration of a roller support part viewed from a central axis direction of a pressure roller.

FIG. 8 is a schematic diagram showing the configuration of the roller support part 65 viewed from the central axis direction of the pressure roller 42. In FIG. 8, to clarify the positional relation among the respective constituent elements, a part of the second arm member 76 is cut.

As shown in FIG. 8, the first arm member 75 and the second arm member 76 are swingably supported about a common rotating support shaft 81. Note that the first arm member 75 and the second arm member 76 are individually swingable about the rotating support shaft 81.

The first arm member 75 is extended from the position of the rotating support shaft 81 through the position under the roller shaft member 42*a* of the pressure roller 42 to the pressure cam 61 side. The first arm member 75 is provided with a support shaft 75*a*. The support shaft 75*a* is provided on the opposite side to the rotating support shaft 81, with the roller shaft member 42*a* of the pressure roller 42, between the support shaft 75*a* and the rotating support shaft 81. A push-up member 75*b* is formed at the end of the first arm member 75. The push-up member 75*b* is provided with two holes 75*c* and 75*d* (see FIG. 9) corresponding to two studs 83 and 84 to be described later.

The cam follower 77 is rotatably attached to the support shaft 75*a* of the first arm member 75. The cam follower 77 is provided so as to be always in contact with the cam surface (outer peripheral surface) of the pressure cam 61. The cam follower 77 is moved in the vertical direction in accordance with rotation of the pressure cam 61. More specifically, in the progress of change of the rotation angle of the pressure cam 61 from θ0 to θ4, the cam follower 77 is moved upward, and in the progress of change of the rotation angle of the pressure cam 61 from θ4 to θ0, the cam follower 77 is moved downward. The first arm member 75 is swung in accordance with movement of the cam follower 77.

Next, the rotation angle of the pressure cam 61 will be described.

The range of the rotation angle of the pressure cam 61 differs in accordance with cam shape. In the present embodiment, the range is θ0 to θ4 as described above. The cam follower 77 in contact with the cam surface of the pressure cam 61 is moved in the vertical direction in accordance with the rotation of the pressure cam 61. In this case, the rotation angle of the pressure cam 61 is defined as follows.

First, when the rotation angle of the pressure cam 61 is θ0, the cam follower 77 is in contact with the cam surface on an axis line J0 at θ0 in FIG. 6. When the rotation angle of the pressure cam 61 is θ1, the cam follower 77 is in contact with the cam surface on an axis line 71 at θ1 in FIG. 6. Similarly, when the rotation angle of the pressure cam 61 is θ2, the cam follower 77 is in contact with the cam surface on an axis line 72 at θ2 in FIG. 6. When the rotation angle of the pressure cam 61 is θ3, the cam follower 77 is in contact with the cam surface on an axis line 73 at θ3 in FIG. 6. When the rotation angle of the pressure cam 61 is θ4, the cam follower 77 is in contact with the cam surface on an axis line J4 at θ4 in FIG. 6.

Returning to FIG. 8, the second arm member 76 has a support member 76*a* to receive and support the roller shaft member 42*a* of the pressure roller 42 from the lower side, and an accommodation member 76*b* to accommodate the above-described two springs 78 and 79. The support member 76*a* is formed in an approximate U-shape viewed from the center axis direction of the pressure roller 42. The support member 76*a* receives and supports the roller shaft member 42*a* of the pressure roller 42 with this U-shape part from the lower side. As shown in FIG. 3 and FIG. 4, the accommodation member 76*b* is formed to be folded in a gate shape. A top plate member 76*c* is integrally formed with the accommodation member 76*b*. The two studs 83 and 84 are attached to the top plate member 76*c*.

The stud 83 is provided in correspondence with the spring 78. The stud 83 is provided over the push-up member 75*b* of the first arm member 75 and the top plate member 76*c* of the second arm member 76. The stud 83 integrally has a head 83*a* and a shaft 83*b*. The head 83*a* is provided to be projected above the top plate member 76*c* of the second arm member 76. The shaft 83*b* is slidably supported with the top plate member 76*c* of the second arm member 76. The spring 78 is attached in a status where it is wound around the shaft 83*b*. Further, a pressure receiving member 86 is attached to the shaft 83*b*. The pressure receiving member 86, while receiving the pressure of the spring 78 in the central axis direction of the shaft 83*b*, regulates the attachment position of the spring 78. The force of the spring 78 acts downward on the stud 83. With this downward spring force, the head 83*a* of the stud 83 is thrusted against the top plate member 76*c*. In this status, when the swing of the second arm member 76 is regulated and the stud 83 is pushed upward against the force of the spring 78, the head 83*a* of the stud 83 moves upward away from the top plate member 76*c*. The force of the spring 78 is applied upward to the top plate member 76*c*, and with this upward spring force, the top plate member 76*c* is pressed upward.

The stud 84 is provided in correspondence with the spring 79. The stud 84 is provided over the push-up member 75*b* of the first arm member 75 and the top plate member 76*c* of the second arm member 76. The stud 84 integrally has a head 84*a* and a shaft 84*b*. The stud 84 is provided, in parallel to the above-described stud 83, next to the stud 83. The head 84*a* is provided to be projected above the top plate member 76*c* of the second arm member 76. The shaft 84*b* is slidably supported with the top plate member 76*c* of the second arm member 76. The spring 79 is attached in a status where it is wound around the shaft 84*b*. Further, a pressure receiving member 87 is attached to the shaft 84*b*. The pressure receiving member 87, while receiving the pressure of the spring 79 in the central axis direction of the shaft 84*b*, regulates the attachment position of the spring 79. The force of the spring 79 acts downward on the stud 84. With this downward spring force, the head 84*a* of the stud 84 is thrusted against the top plate member 76*c*. In this status, when the swing of the second arm member 76 is regulated and the stud 84 is pushed upward against the force of the spring 79, the head 84*a* of the stud 84 moves upward away from the top plate member 76*c*. The force of the spring 79 is applied upward to the top plate member 76*c*, and with this upward spring force, the top plate member 76*c* is pressed upward.

The spring 78 corresponds to a first elastic member having a first elastic modulus. The spring 78 is configured with a compression coil spring. On the other hand, the spring 79 corresponds to a second elastic member having a second elastic modulus. The spring 79 is configured with a compression coil spring. In the present embodiment, the wire diameters of the springs are different such that the elastic modulus of the spring 78 and the elastic modulus of the spring 79 are different. More specifically, the spring 78 is formed with a spring material having a thick wire diameter, while the spring 79 is formed with a spring material having a thin wire diameter. The spring constant of the spring 78 is larger than the spring constant of the spring 79. Note that the elastic moduli of the two springs 78 and 79 may be changed in accordance with other element than the wire diameter of the spring material.

Figure 9:
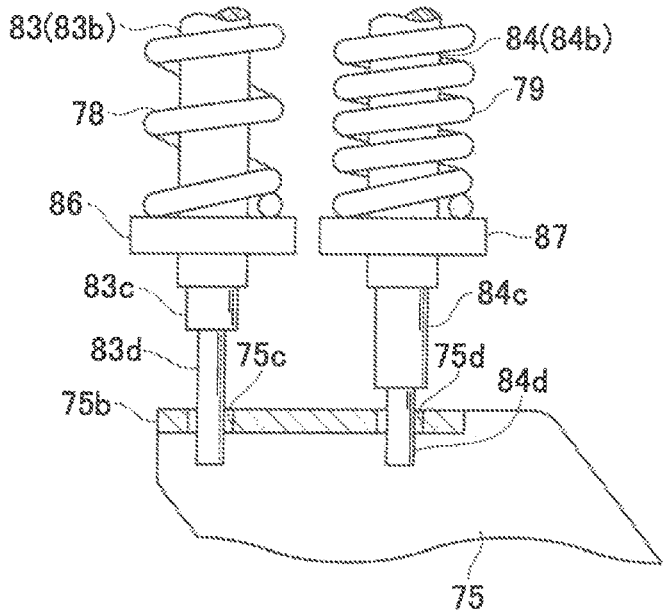
FIG. 9 is a cross-sectional view showing a placement status of a first arm member and two studs.

FIG. 9 is a cross-sectional view showing a placement status of the first arm member 75 and the two studs 83 and 84.

As shown in FIG. 9, the lower end side of the stud 83 has a stepped structure where the outer diameter is stepwisely narrowed. With this stepped structure, a thrusted member 83*c* and a pin 83*d* are formed integrally with the stud 83. When the pressure roller 42 is pressed against the fixing roller 41 with the pressing mechanism 45, the push-up member 75*b* of the first arm member 75 is thrusted against the thrusted member 83*c*. The thrusted member 83*c* is formed to have an outer diameter larger than that of the pin 83*d*. The pin 83*d* is a part having a minimum outer diameter in the central axis direction of the stud 83. The pin 83*d* is formed at the lower end of the stud 83. On the other hand, a hole 75*c* is formed through the push-up member 75*b* of the first arm member 75. The pin 83*d* of the stud 83 is inserted through the hole 75*c*. The inner diameter of the hole 75*c* is smaller than the outer diameter of the thrusted member 83*c* and larger than the outer diameter of the pin 83*d*.

On the other hand, the lower end side of the stud 84 also has a stepped structure where the outer diameter is stepwisely narrowed. With this stepped structure, a thrusted member 84*c* and a pin 84*d* are formed integrally with the stud 84. When the pressure roller 42 is pressed against the fixing roller 41 with the pressing mechanism 45, the push-up member 75*b* of the first arm member 75 is thrusted against the thrusted member 84*c*. The thrusted member 84*c* is formed to have an outer diameter larger than that of the pin 84*d*. The pin 84*d* is a part having a minimum outer diameter in the central axis direction of the stud 84. The pin 84*d* is formed at the lower end of the stud 84. On the other hand, a hole 75*d* is formed through the push-up member 75*b* of the first arm member 75. The pin 84*d* of the stud 84 is inserted through the hole 75*c*. The inner diameter of the hole 75*d* is smaller than the outer diameter of the thrusted member 84*c* and larger than the outer diameter of the pin 84*d*.

Next, as the operation of the fixing apparatus 40 of the image forming apparatus 1 according to the present invention, the operation upon pressing of the pressure roller 42 with the pressing mechanism 45 against the fixing roller 41 will be described.

First, when the rotation angle of the pressure cam 61 is θ0, the cam follower 77 in contact with the pressure cam 61 is located in the lowest position. In this status, the pressure roller 42 is away from the fixing roller 41. The nip pressure of the fixing nip part 44 (see FIG. 1) between the fixing roller 41 and the pressure roller 42 is 0 (zero).

On the other hand, when the pressure cam 61 is rotated along with the cam shaft 62 by the driving of the stepping motor 63, the cam follower 77 is moved upward in accordance with change of the rotation angle of the pressure cam 61. Hereinbelow, the operation of the fixing apparatus 40 will be described as the first step where the rotation angle of the pressure cam 61 is changed from θ0 to θ1, the second step where the rotation angle of the pressure cam 61 is changed from θ1 to θ2, the third step where the rotation angle of the pressure cam 61 is changed from θ2 to θ3, and the fourth step where the rotation angle of the pressure cam 61 is changed from θ3 to θ4.

(First Step)

Figure 10:
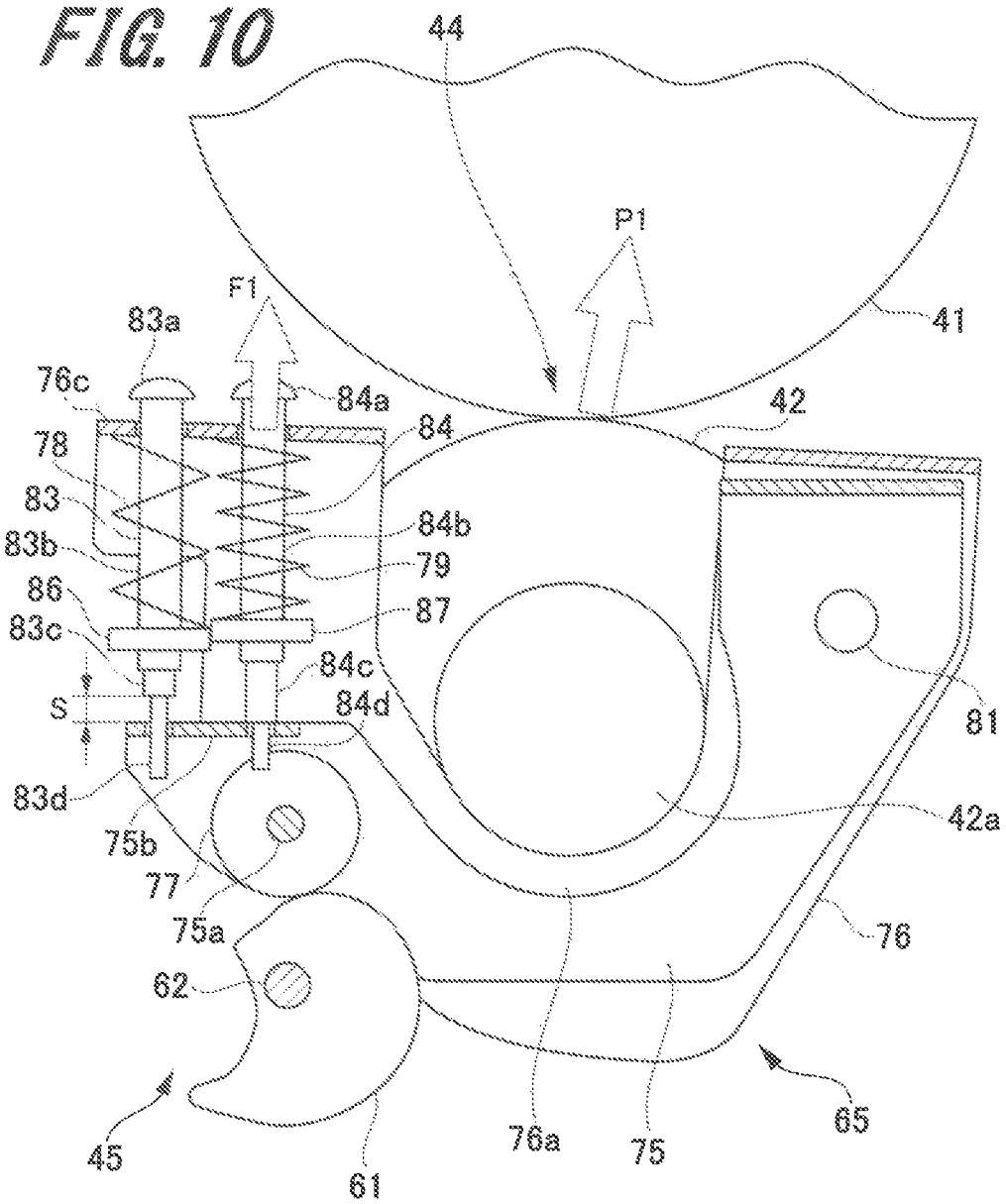
FIG. 10 is a schematic cross-sectional view showing a first operation status of the pressing mechanism.

First, at the first step where the rotation angle of the pressure cam 61 is changed from θ0 to θ1, the cam follower 77, in contact with the first cam surface region 611 of the pressure cam 61, is pressed with the cam surface of the first cam surface region 611 and is moved upward. When the cam follower 77 is moved upward, the first arm member 75 is swung about the rotating support shaft 81 in accordance with the movement of the cam follower 77. With this configuration, the end side of the first arm member 75 is raised. Then as shown in FIG. 10, the push-up member 75*b* of the first arm member 75 is thrusted against the thrusted member 84*c* of the stud 84. With this configuration, the entire stud 84 is pushed up with the push-up member 75*b*, and the spring 79 is compressed in correspondence with the push-up amount.

On the other hand, a gap S exists between the thrusted member 83*c* of the stud 83 and the push-up member 75*b* of the first arm member 75. The top plate member 76*c* of the second arm member 76 receives only a counterforce F1 by the compression of the spring 79 and is pressed upward. The upward force by this pressing is applied from the support member 76*a* of the second arm member 76 to the roller shaft member 42*a* of the pressure roller 42.

As a result, the counterforce F1 by the compression of the spring 79 is applied as a pressing force to the pressure roller 42. With this pressing force, the pressure roller 42 is press-fixed against the fixing roller 41. In this case, as the spring 79 is configured with the spring member having a thin wire diameter, pressing load P1, applied to the pressure roller 42 with the counterforce F1 of the spring 79, is comparatively small load. Accordingly, the pressure roller 42 is in lightly contact (press-fixed to) with the fixing roller 41.

(Second Step)

At the second step where the rotation angle of the pressure cam 61 is changed from θ1 to θ2, a status where the cam follower 77 is in contact with the cam flat part 613 of the pressure cam 61 is maintained. The cam height of the cam flat part 613 is constant. While the cam follower 77 is in contact with the cam flat part 613, the cam follower 77 is fixedly provided in the constant height position. The status where the pressure roller 42 is lightly in contact with the fixing roller 41 is maintained.

(Third Step)

Figure 11:
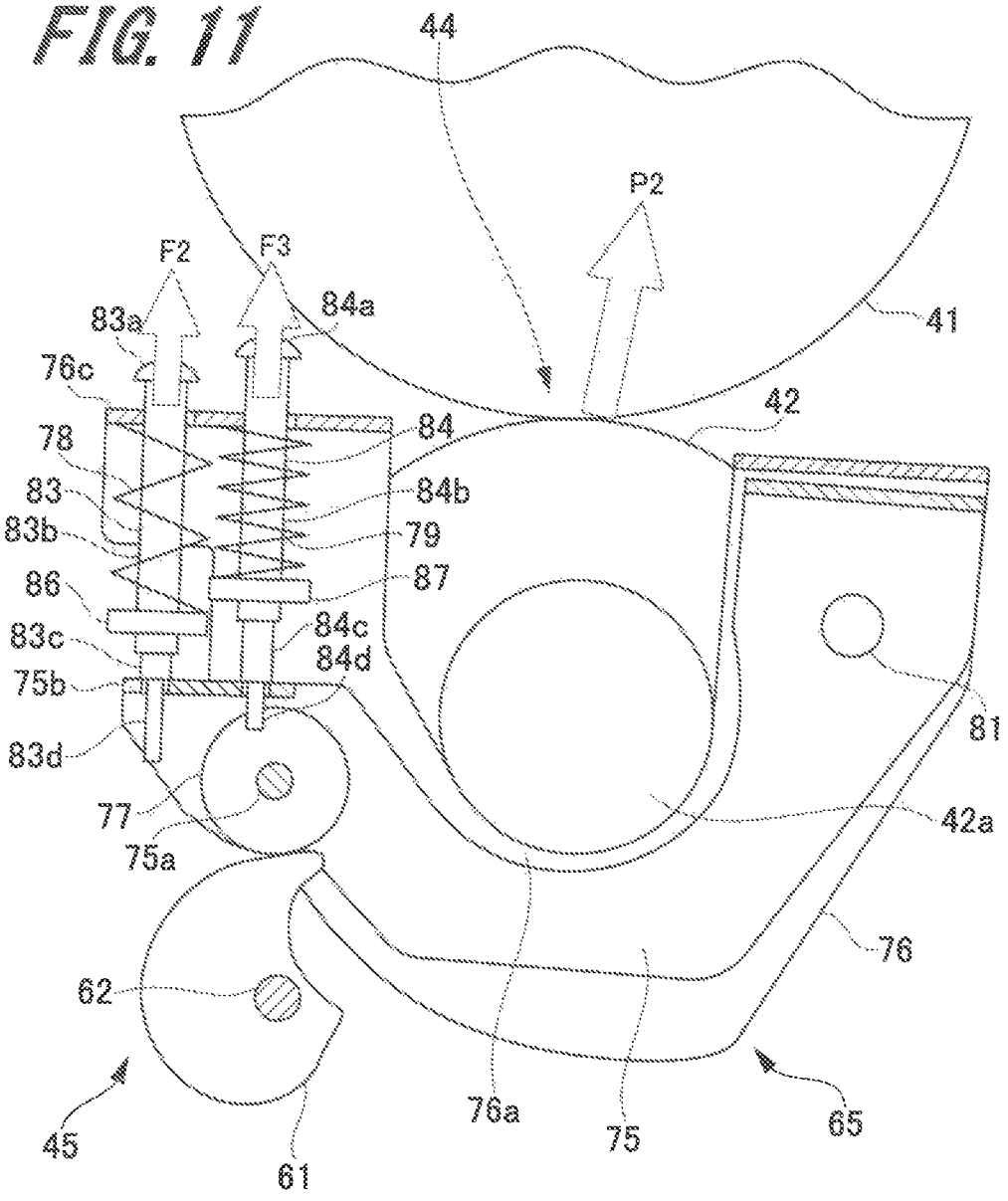
FIG. 11 is a schematic cross-sectional view showing a second operation status of the pressing mechanism.

At the third step where the rotation angle of the pressure cam 61 is changed from θ2 to θ3, the cam follower 77, in contact with the second cam surface region 612 of the pressure cam 61, is pressed with the cam surface of the second cam surface region 612 and is moved upward. Then, as shown in FIG. 11, the push-up member 75*b* of the first arm member 75, thrusted against the thrusted member 84*c* of the stud 84, is further thrusted against the thrusted member 83*c* of the stud 83. With this configuration, both the stud 83 and the stud 84 are pushed up with the push-up member 75*b*, and both the spring 78 and the spring 79 are compressed in correspondence with the push-up amount. The top plate member 76*c* of the second arm member 76 receives a counterforce F2 by the compression of the spring 78 and a counterforce F3 by the compression of the spring 79 simultaneously, and is pressed upward. The upward force by the pressing is applied from the support member 76*a* of the second arm member 76 to the roller shaft member 42*a* of the pressure roller 42.

As a result, a force obtained by adding the counterforce F2 by the compression of the spring 78 and the counterforce F3 by the compression of the spring 79 is applied as a pressing force to the pressure roller 42. With this pressing force, the pressure roller 42 is press-fixed to the fixing roller 41. In this case, as the spring 78 is configured with the spring material having a thick wire diameter, the counterforce F2 by the compression of the spring 78 becomes larger than the counterforce F1 obtained at the first step. Further, at the third step, the spring 79 is further compressed in comparison with the first step. The counterforce F3 by the compression of the spring 79 becomes larger than the counterforce F1 obtained at the first step. Accordingly, pressing load P2, applied to the pressure roller 42 by the counterforces F1 and F2 of the two springs 78 and 79, is comparatively strong load. The pressure roller 42 is strongly in contact with (press-fixed to) the fixing roller 41. Further, at the third step, as the cam follower 77 is gradually moved upward in the progress of change of the rotation angle of the pressure cam 61 from θ2 to θ3, the pressing load P2 applied to the pressure roller 42 gradually becomes large. When the rotation angle of the pressure cam 61 becomes θ3, the pressing load P2 applied to the pressure roller 42 becomes the maximum.

(Fourth Step)

At the fourth step where the rotation angle of the pressure cam 61 is changed from θ3 to θ4, the status where the cam follower 77 is in contact with the cam flat part 614 of the pressure cam 61 is maintained. The cam height of the cam flat part 614 is constant. While the cam follower 77 is in contact with the cam flat part 614, the cam follower 77 is fixedly provided in the constant height position. The status where the pressure roller 42 is strongly in contact with the fixing roller 41 is maintained.

In this manner, in the fixing apparatus 40 according to the first embodiment of the present invention, the pressing mechanism 45 is configured by using the two springs 78 and 79 having different elastic moduli. Accordingly, for example, weak nip pressure corresponding to the pressing load P1 is set by mainly utilizing the force of the spring 79, while strong nip pressure corresponding to the pressing load P2 is set by mainly utilizing the force of the spring 78. It is possible to set the nip pressure of the fixing nip part 44 with high precision. Further, in comparison with a case where one spring is used, it is possible to ensure a wide nip pressure range.

Further, in the fixing apparatus 40 according to the first embodiment of the present invention, the configuration where the cam flat part 613 is provided on one end side of the second cam surface region 612 of the pressure cam 61 and the cam flat part 614 is provided on the other end side of the second cam surface region 612 is employed. With this configuration, it is possible to respectively ensure a wide cam surface region where weak nip pressure corresponding to the pressing load P1 is obtained and a wide cam surface region where strong nip pressure corresponding to the pressing load P2 is obtained, in the rotation direction of the pressure cam 61. Accordingly, it is possible to simply and accurately set the nip pressure of the fixing nip part 44 with high precision.

Note that in the first embodiment of the present invention, the pressing mechanism 45 is configured with the two springs 78 and 79, however, the number of elastic members having different elastic moduli may be three or more.

<Fixing Apparatus Control Configuration>

Figure 12:
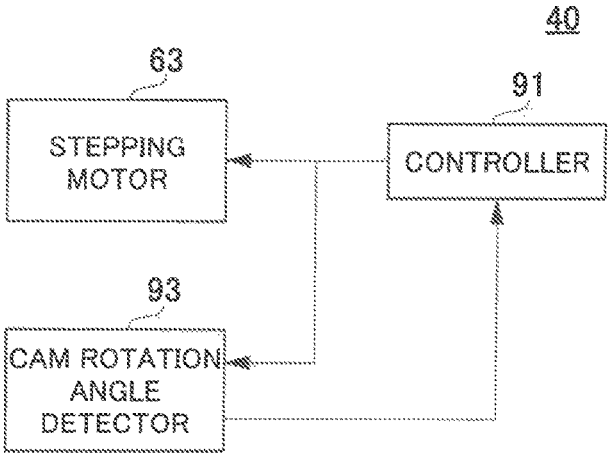
FIG. 12 is a block diagram showing the configuration of a control system of the fixing apparatus according to the first embodiment of the present invention.

FIG. 12 is a block diagram showing the configuration of a control system of the fixing apparatus according to the first embodiment of the present invention.

As shown in FIG. 12, the fixing apparatus 40 has the controller 91 to control the operation of the fixing apparatus 40, and a cam rotation angle detector 93 to detect the rotation angle of the pressure cam 61. The controller 91 and the cam rotation angle detector 93 are respectively configured with a computer having a CPU (Central Processing Unit), a ROM (Read Only Memory), a RAM (Random Access Memory) and the like. The controller 91 controls the rotation of the pressure cam 61 using the pressing mechanism 45 with the stepping motor 63 as a driving source. The stepping motor 63 as one of control targets is electrically connected to the controller 91. When the controller 91 controls the nip pressure of the fixing nip part 44 by the operation of the pressing mechanism 45, the controller 91 supplies an input pulse to the stepping motor 63 to control the rotation angle and the rotation direction of the stepping motor 63. Further, when the controller 91 changes the nip pressure of the fixing nip part 44 by the operation of the pressing mechanism 45, the controller 91 stops the stepping motor 63 in an excited status, to maintain the changed nip pressure.

The cam rotation angle detector 93 detects the rotation angle of the pressure cam 61 based on the input pulse supplied from the controller 91 to the stepping motor 63. The detection result from the cam rotation angle detector 93 is supplied to the controller 91. The rotation angle of the pressure cam 61 is an angle defined within e.g. an angle range from θ0 to θ4 as described above. The rotation angle is an element to determine the attitude of the pressure cam 61 viewed from the central axis direction of the cam shaft 62.

Assuming that the number of input pulses necessary to change the rotation angle of the pressure cam 61 from θ0 to θ4 is N, it is possible to specify the actual rotation angle of the pressure cam 61 with an input pulse count value within the range of 0 to N. Accordingly, the cam rotation angle detector 93 counts the number of input pulses supplied to the stepping motor 63, and detects the rotation angle of the pressure cam 61 based on the count value. For example, when an input pulse is supplied to the stepping motor 63 in a direction to increase the rotation angle of the pressure cam 61, from the status where the pressure cam 61 is stopped at a rotation angle corresponding to an input pulse number n1, the cam rotation angle detector 93 performs counting to add the number of newly-supplied input pulses with respect to the current number of input pulses n1, and the cam rotation angle detector 93 detects the rotation angle of the pressure cam 61 based on the count value. Further, when an input pulse is supplied to the stepping motor 63 in a direction to reduce the rotation angle of the pressure cam 61, from the status where the pressure cam 61 is stopped at a rotation angle corresponding to an input pulse number n2, the cam rotation angle detector 93 performs counting to subtract the number of newly-supplied input pulses from the current number of input pulses n2, and the cam rotation angle detector 93 detects the rotation angle of the pressure cam 61 based on the count value.

In this manner, by detecting the rotation angle of the pressure cam 61 based on input pulses inputted into the stepping motor 63, it is possible to detect the attitude of the pressure cam 61 with a simple configuration. Note that the cam rotation angle detector 93 may be configured, as a function of the controller 91, integrally with the controller 91.

Next, an example of control processing with the above-described control system of the fixing apparatus 40 will be described.

First, the controller 91 controls driving of the stepping motor 63 by supplying an input pulse to the stepping motor 63 in correspondence with type of recording medium used in image formation. At this time, the controller 91 supplies an input pulse to the pressure cam 61 in the direction to increase the rotation angle of the pressure cam 61 or in the direction to reduce the rotation angle of the pressure cam 61 so as to bring the rotation angle of the pressure cam 61 closer to a target angle corresponding to the type of the recording medium. Further, the cam rotation angle detector 93 detects the rotation angle of the pressure cam 61 based on the input pulse supplied to the stepping motor 63, and supplies the detection result to the controller 91. With this configuration, the controller 91 inputs an input pulse to the stepping motor 63 until the rotation angle of the pressure cam 61 detected with the cam rotation angle detector 93 matches the target angle. In this manner, when the controller 91 controls driving of the stepping motor 63, the pressure cam 61 is rotated in accordance with the driving of the stepping motor 63. Then at the stage where the rotation angle of the pressure cam 61 matches the target angle, the rotation of the pressure cam 61 is stopped.

On the other hand, the nip pressure of the fixing nip part 44 is changed in correspondence with rotation amount and rotation direction of the pressure cam 61. Accordingly, it is possible to set the nip pressure of the fixing nip part 44 to nip pressure appropriate to the type of the recording medium by controlling the driving of the stepping motor 63 in correspondence with type of the recording medium with the controller 91. Further, when the type of the recording medium is changed during the print job, the nip pressure is changed by controlling the driving of the stepping motor 63 with the controller 91 after passage of one type of recording medium through the fixing nip part 44 before another type of recording medium arrives at the fixing nip part 44. With this configuration, when image formation is performed by continuously conveying recording media of different types, e.g., recording media having different thicknesses (basis weights), it is possible to fix a toner image, with nip pressure appropriate to each of thicknesses of the recording media, to the respective recording media.

Further, when the rotation angle of the pressure cam 61 is changed by driving of the stepping motor 63 as described above, the controller 91 controls rotation of the pressure cam 61 with the top dead center or the bottom dead center previously set in the rotation direction of the pressure cam 61 as a starting point. For example, when the rotation of the pressure cam 61 is controlled with the top dead center as a starting point, first, the pressure cam 61 is rotated such that the rotation angle of the pressure cam 61 becomes θ4, and with the rotated position as a starting point, the pressure cam 61 is rotated by a predetermined amount. Further, when the rotation of the pressure cam 61 is controlled with the bottom dead center as a starting point, first, the pressure cam 61 is rotated such that the rotation angle of the pressure cam 61 becomes θ0, and with the rotated position as a starting point, the pressure cam 61 is rotated by a predetermined amount. The arrival of the pressure cam 61 at the top dead center or the bottom dead center may be detected by using an unshown sensor. In this manner, by controlling the rotation of the pressure cam 61, when the power transmission part 64 is configured with the multiple gears G1 to G8 as described above, it is possible to suppress the influence of backlash which occurs in an engagement part between the respective gears, and to control the rotation angle (attitude) of the pressure cam 61 in a stable manner and with high precision.

Further, upon execution of a print job in the image forming apparatus 1, from the start to the end of the print job, i.e., during the print job, the controller 91 performs control to change the rotation angle of the pressure cam 61 based on predetermined conditions. Various conditions may be conceivable as the predetermined conditions. In the present embodiment, as examples, a case where the predetermined condition is the type of recording medium, and a case where the predetermined condition is the temperature of the fixing roller 41, will be described respectively.

(When Predetermined Condition is Type of Recording Medium)

First, in a print job specified with the image forming apparatus 1, the type of the recording medium may be changed during the print job. In such a case, the controller 91 changes the rotation angle of the pressure cam 61 by driving the stepping motor 63 after the passage of the first type of recording medium through the fixing nip part 44 before the second type of recording medium arrives at the fixing nip part 44. With this configuration, the nip pressure of the fixing nip part 44 is changed in correspondence with type of the recording medium. When image formation is performed by continuously conveying recording media of different types, e.g., recording media having different thicknesses (basis weights), it is possible to fix a toner image, with nip pressure respectively appropriate to each of the thicknesses of the recording media, to the respective recording media. Further, when cardboard and thin paper as recording media are sequentially conveyed and a toner image is fixed to the respective recording media, a proper fixing temperature of the cardboard is higher than that of the thin paper. When the toner image is sequentially fixed to the cardboard and thin paper, first, the toner image is fixed to the cardboard, then, it is necessary to lower the fixing temperature before fixing of the toner image to the thin paper. However, it takes a long time to lower the fixing temperature. When the waiting time for lowering the fixing temperature is added, the productivity of image formation is lowered. Regarding this point, in the present embodiment, it is possible to change the nip pressure by the rotation of the pressure cam 61 and to maintain the changed nip pressure in a stable manner. It is possible to reduce the amount of heat added to the recording medium passing through the fixing nip part 44 by reducing the nip pressure (nip width) by the rotation of the pressure cam 61 after the fixing of the toner image to the cardboard before the fixing of the toner image to the thin paper. With this configuration, even though the fixing temperature after the passage of the cardboard is not lowered so much, it is possible to fix the toner image to the thin paper with the amount of heat appropriate to fixing to the thin paper. Accordingly, it is possible to reduce the waiting time to lower the fixing temperature, and to improve the productivity of image formation.

(When Predetermined Condition is Temperature of Fixing Roller 41)

Generally, as the temperature of the fixing roller 41, a proper temperature range is previously determined in correspondence with type of the recording medium 2 or the like. The heater is controlled such that the temperature of the fixing roller 41 stands within the temperature range. However, due to various reasons, the temperature of the fixing roller 41 may be changed during the print job. When the temperature of the fixing roller 41 is high or low beyond the proper temperature range, variation may occur in quality (e.g., density) of the image fixed to the recording medium 2 with the fixing apparatus 40.

In the present embodiment, to adjust (correct) the nip pressure of the fixing nip part 44 in correspondence with temperature change of the fixing roller 41, the detection result of a temperature sensor (not shown) which detects the temperature of the fixing roller 41 is inputted into the controller 91. With this configuration, the controller 91 obtains the temperature of the fixing roller 41. Further, with respect to a target temperature of the fixing roller 41 previously set in correspondence with type of the recording medium 2 or the like, a high-temperature side threshold value higher than the target temperature and a low-temperature side threshold value lower than the target temperature are set (stored) in the controller 91.

During the print job, the controller 91 continuously monitors the temperature of the fixing roller 41 inputted from the temperature sensor. The controller 91 repeatedly determines whether the temperature of the fixing roller 41 inputted from the temperature sensor is equal to or higher than the above-described high-temperature side threshold value or equal to or lower than the low-temperature side threshold value. When the temperature of the fixing roller 41 inputted from the temperature sensor is equal to or higher than the high-temperature side threshold value, the controller 91 rotates the stepping motor 63 by a predetermined number of steps in a direction where the rotation angle of the pressure cam 61 becomes smaller than the current set angle. With this configuration, the nip pressure of the fixing nip part 44 is corrected to be lower than the current set pressure. On the other hand, when the temperature of the fixing roller 41 inputted from the temperature sensor is equal to or lower than the low-temperature side threshold value, the controller 91 rotates the stepping motor 63 by a predetermined number of steps in a direction where the rotation angle of the pressure cam 61 becomes larger than the current set angle. With this configuration, the nip pressure of the fixing nip part 44 is corrected to be higher than the current set pressure.

In this manner, it is possible to adjust (correct) the nip pressure of the fixing nip part 44 in accordance with temperature change of the fixing roller 41 by changing the rotation angle of the pressure cam 61 with the controller 91 based on the temperature of the fixing roller 41. Accordingly, it is possible to suppress variation in image quality due to temperature change of the fixing roller 41.

Advantages of First Embodiment

In the first embodiment of the present invention, as a driving source of the pressing mechanism 45 of the fixing apparatus 40, the stepping motor 63 is adopted, and the multiple gears G1 to G8 are provided in the power transmission part 64 from the stepping motor 63 to the cam shaft 62. The gear G3 among the multiple gears is configured with a worm. With this configuration, it is possible to change the nip pressure of the fixing nip part 44 to multiple nip pressures by utilizing the rotation of the pressure cam 61 without troublesome procedure. The reasons are as follows. First, the gear G3 provided in the middle of the power transmission path of the power transmission part 64, i.e., the worm receives the driving force of the stepping motor 63 as the driving source and is rotated, to rotate the gear engaged with the worm (the gear G4 in the present embodiment), since the power transmission is smoothly performed from the gear G3 as a worm to the gear G4 engaged with the gear G3. However, on the contrary, the power transmission from the gear G4 to the gear G3 is substantially cut due to a strong friction force caused in the engagement part between the gears G3 and G4. This phenomenon is also referred to as "self-lock function". With this self-lock function, the rotation of the gear G3 is prevented. Especially, when it is configured such that the gear G4 as a worm wheel is engaged with the gear G3 as a worm, a further large friction force is caused in the engagement part between the gears G3 and G4. It is possible to reliably prevent the power transmission from the gear G4 to the gear G3 and the rotation of the gear G3. Even when a rotation force is applied to the pressure cam 61 and the cam shaft 62 for some reason and the rotation force is added via the gear G8, the gear G7, the gear G6 and the gear G5 to the gear G4, the power transmission from the gear G4 to the gear G3 is cut, and the status where the gear G3 is stopped is maintained. On the other hand, when the stepping motor 63 in an excited status (energized status) is stopped, the stepping motor 63 in the status where it is stopped with a static force (static torque) corresponding to motor characteristic is maintained. With the static force obtained with the stepping motor 63 in the excited status and the friction force caused in the contact part between the gear (worm) G3 and the gear (worm wheel) G4, it is possible to stop the pressure cam 61 in an arbitrary rotation position (rotation angle), and to maintain the status. With this configuration, it is possible to change the nip pressure of the fixing nip part 44 to multiple nip pressures by utilizing the rotation of the pressure cam 61 without troublesome procedure. Further, the rotation angle of the pressure cam 61 can be changed within the range of θ0 to θ4. Assuming that the angle range to obtain the press-fixed status between the fixing roller 41 and the pressure roller 42 is from θ0 to θ4, it is possible to arbitrarily change the nip pressure of the fixing nip part 44 within this the angle range of θ0 to θ4.

Second Embodiment

Next, a second embodiment of the present invention will be described. In comparison with the above-described first embodiment, the second embodiment differs in the configuration to detect the rotation angle of the pressure cam 61. Note that in the second embodiment, the constituent elements similar to or corresponding to the constituent elements given in the above-described first embodiment will have the same reference numerals, and overlapped contents will be omitted.

Figure 13:
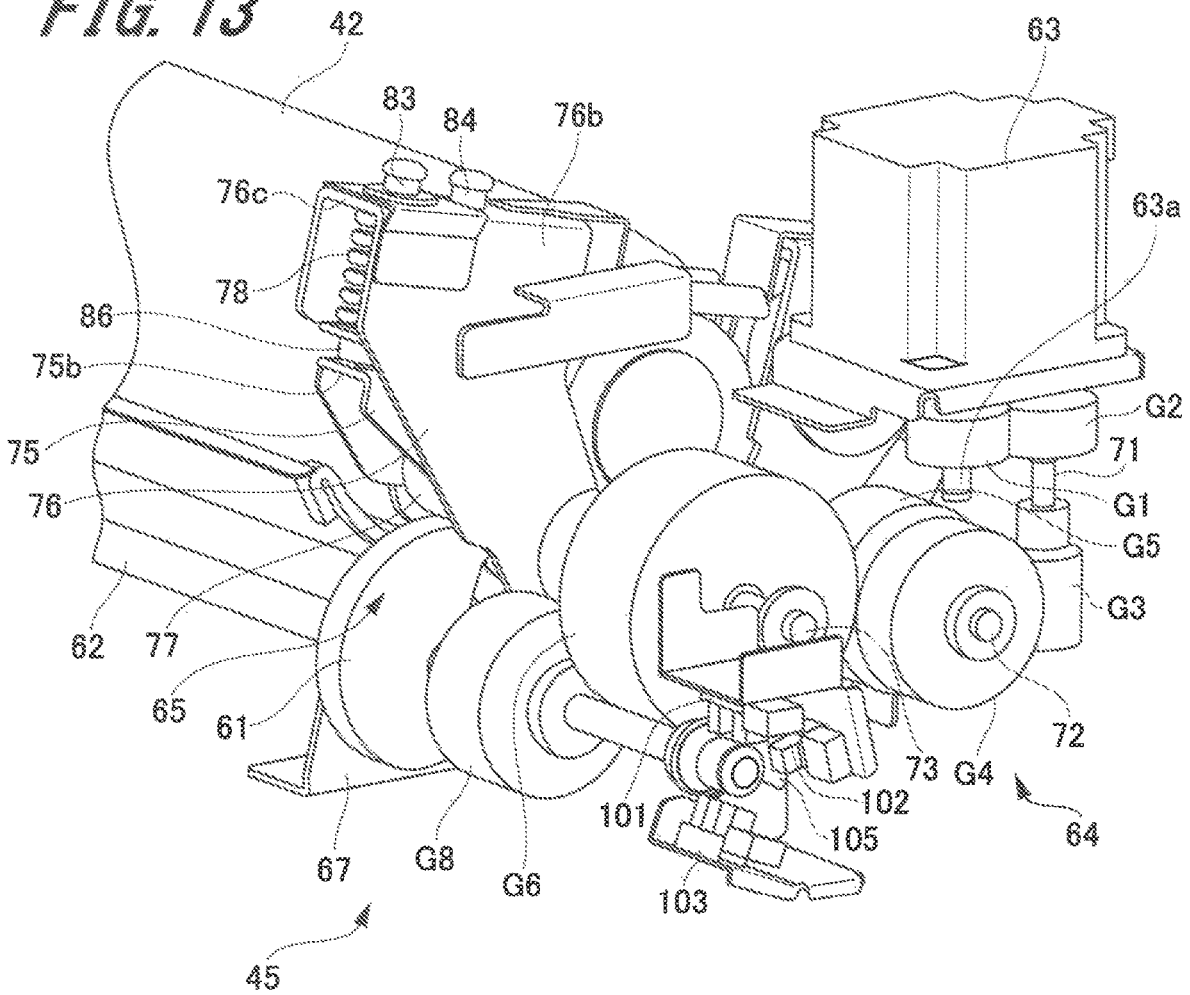
FIG. 13 is a perspective view showing the main part of the fixing apparatus according to a second embodiment of the present invention.
Figure 14:
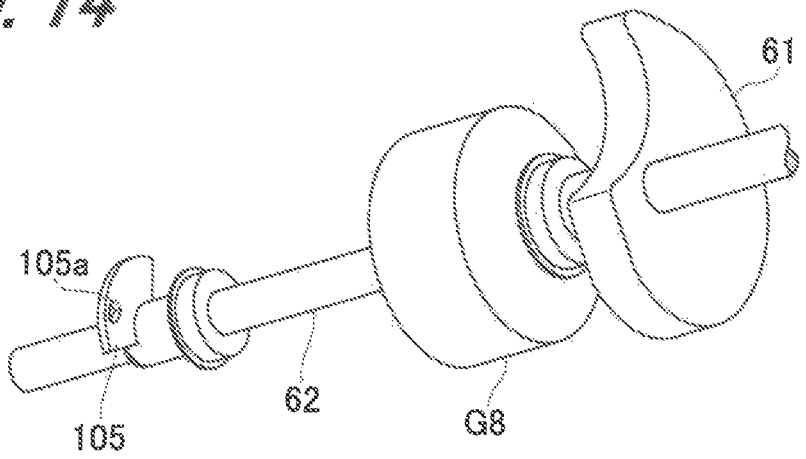
FIG. 14 is a perspective view showing a part attached to a cam shaft in the second embodiment of the present invention.
Figure 15:
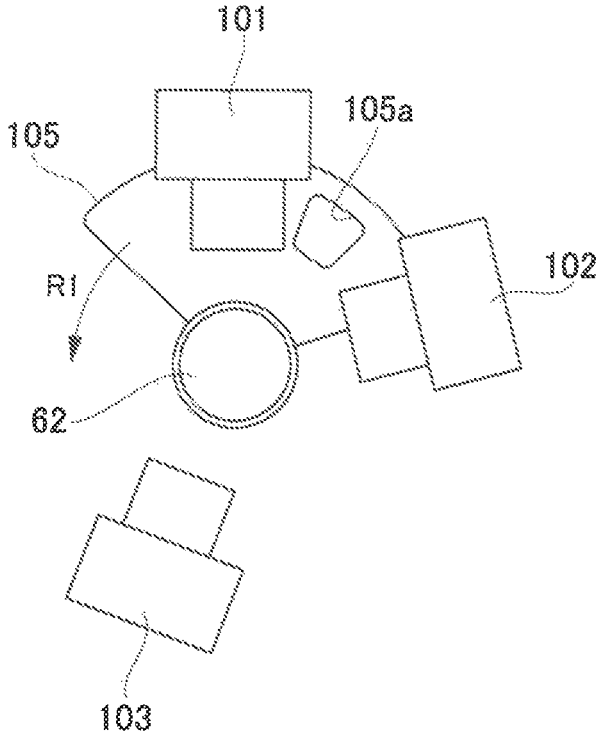
FIG. 15 is a schematic diagram showing the arrangement of optical sensors used for detection of a rotation angle of the pressure cam in the fixing apparatus according to the second embodiment of the present invention.

FIG. 13 is a perspective view showing the main part of the fixing apparatus according to the second embodiment of the present invention. FIG. 14 is a perspective view showing a part attached to the cam shaft in the second embodiment of the present invention. FIG. 15 is a schematic diagram showing the arrangement of optical sensors used for detection of the rotation angle of the pressure cam in the fixing apparatus according to the second embodiment of the present invention. FIG. 15 is a diagram viewed from the central axis direction of the cam shaft 62.

As shown in FIG. 13 and FIG. 15, three optical sensors 101, 102, and 103 are provided about the shaft of the cam shaft 62. The three optical sensors 101, 102, and 103 are provided in positions away from the axial center of the cam shaft 62 in a radial direction by equal distance. The optical axes of the respective optical sensors 101, 102, and 103 exist on the same circumference about the cam shaft 62.

In the present embodiment, as an example, the respective optical sensors 101, 102, and 103 are configured with a transmission type photosensor (photo interrupter). The transmission type photosensor has mutually opposing light emitting element and photodetection element. When the photodetection element receives the light from the light emitting element, the transmission type photosensor becomes in a light input status. When the light from the light emitting element is cut, the transmission type photosensor becomes in a light shielded status. In the present embodiment, an output signal of the transmission type photosensor forming the respective optical sensors 101, 102, and 103 is in an ON status when the sensor is in the light input status, and in an OFF status where the sensor is in the light shielded status.

On the other hand, a light shielding plate 105 is attached to the cam shaft 62. The light shielding plate 105 is a member to change the ON/OFF status of the respective optical sensors 101, 102, and 103 by the rotation of the cam shaft 62. The light shielding plate 105 is attached, together with the pressure cam 61 and the gear G8, to the cam shaft 62. The light shielding plate 105 is rotated integrally with the cam shaft 62. The light shielding plate 105 is formed in a fan shape viewed from the central axis direction of the cam shaft 62. The light shielding plate 105 is provided with a hole 105*a*. The light shielding plate 105 is provided such that when the light shielding plate 105 is rotated integrally with the cam shaft 62, the light shielding plate 105 is made to pass between the light emitting element and the photodetection element of the respective optical sensors 101, 102, and 103. Further, the hole 105*a* of the light shielding plate 105 is provided such that when the light shielding plate 105 is rotated integrally with the cam shaft 62, the hole 105*a* is made to pass through the optical axis of the respective optical sensors 101, 102, and 103.

In the fixing apparatus 40, provided with the three optical sensors 101, 102, and 103, and the light shielding plate 105, having the above configuration, when the pressure cam 61 and the cam shaft 62 are rotated by the driving of the stepping motor 63, the statuses of the respective optical sensors 101, 102, and 103 change as shown in Table 1.

TABLE 1

| PRESS-FIXED/RELEASED STATUS | ROTATION ANGLE OF LIGHT SHIELDING PLATE | STATUS CHANGE OF OPTICAL SENSOR | | |
|---|---|---|---|---|
| | | SENSOR 101 | SENSOR 102 | SENSOR 103 |
| RELEASED | 0° | LIGHT SHIELDED (OFF) | LIGHT SHIELDED (OFF) | LIGHT INPUT (ON) |
| | | LIGHT SHIELDED (OFF) | LIGHT INPUT (ON) | LIGHT INPUT (ON) |
| | | LIGHT INPUT (ON) | LIGHT INPUT (ON) | LIGHT INPUT (ON) |
| | | LIGHT SHIELDED (OFF) | LIGHT INPUT (ON) | LIGHT INPUT (ON) |
| | 80° | LIGHT SHIELDED (OFF) | LIGHT INPUT (ON) | LIGHT INPUT (ON) |
| | | LIGHT INPUT (ON) | | |
| | | LIGHT INPUT (ON) | LIGHT INPUT (ON) | LIGHT INPUT (ON) |
| | | LIGHT INPUT (ON) | LIGHT INPUT (ON) | LIGHT SHIELDED (OFF) |
| FIRST PRESS-FIXED | 130° | LIGHT INPUT (ON) | LIGHT INPUT (ON) | LIGHT SHIELDED (OFF) |
| | | LIGHT INPUT (ON) | LIGHT INPUT (ON) | LIGHT SHIELDED (OFF) |
| | | LIGHT INPUT (ON) | LIGHT INPUT (ON) | LIGHT INPUT (ON) |
| SECOND PRESS-FIXED | 194° | LIGHT INPUT (ON) | LIGHT INPUT (ON) | LIGHT INPUT (ON) |
| | | LIGHT INPUT (ON) | LIGHT INPUT (ON) | LIGHT SHIELDED (OFF) |
| | | LIGHT INPUT (ON) | LIGHT INPUT (ON) | LIGHT INPUT (ON) |

TABLE 1-continued

| PRESS-FIXED/RELEASED STATUS | ROTATION ANGLE OF LIGHT SHIELDING PLATE | STATUS CHANGE OF OPTICAL SENSOR | | |
|---|---|---|---|---|
| | | SENSOR 101 | SENSOR 102 | SENSOR 103 |
| | | LIGHT INPUT (ON) | LIGHT SHIELDED (OFF) | LIGHT INPUT (ON) |
| | | LIGHT INPUT (ON) | LIGHT INPUT (ON) | LIGHT INPUT (ON) |
| THIRD PRESS-FIXED | 316° | LIGHT SHIELDED (OFF) | LIGHT INPUT (ON) | LIGHT INPUT (ON) |

In the Table 1, "press-fixed/released status" between the fixing roller 41 and the pressure roller 42 is given in the left end field. The "press-fixed/releasing status" mainly includes four statuses, i.e., "released" status, "first press-fixed" status, "second press-fixed" status, and "third press-fixed" status. The "released" status means a status where the pressure roller 42 is away from the fixing roller 41 and the press-fixed status between the both rollers is released. The "first press-fixed" status means a status where the pressure roller 42 is press-fixed with a first pressurizing force to the fixing roller 41. The "second press-fixed" status means a status where the pressure roller 42 is press-fixed with a second pressurizing force larger than the first pressurizing force to the fixing roller 41. The "third press-fixed" status means a status where the pressure roller 42 is press-fixed with a third pressurizing force larger than the second pressurizing force to the fixing roller 41. The "first press-fixed" status is applied when e.g. an envelope is used as a recording medium. The "second press-fixed" status is applied when e.g. mixedly supplied thin paper is used as a recording medium. The "third press-fixed" status is applied when e.g. plain paper or cardboard is used as a recording medium.

In the Table 1, several rotation angles of the light shielding plate 105 (0°, 80°, 130°, 194°, and 316°) are given in the second field from the left. The rotation angle of the light shielding plate 105 when the pressure roller 42 is away from the fixing roller 41, i.e., the rotation angle of the light shielding plate 105 in the above "released" status, is 0°. The rotation angle of the light shielding plate 105 corresponds to the rotation angle of the pressure cam 61. More specifically, when θ0=0° holds as the rotation angle of the pressure cam 61, the rotation angle of the light shielding plate 105 is 0°. When θ4=316° holds as the rotation angle of the pressure cam 61, the rotation angle of the light shielding plate 105 is 316°. This relationship holds regarding the other rotation angles.

In the Table 1, the status change of the respective optical sensors 101, 102, and 103, when the pressure cam 61 and the light shielding plate 105 are rotated integrally with the cam shaft 62 is given in the third field from the left. As described above, the status of the respective optical sensors 101, 102, and 103 includes the light input status and the light shielded status. The output signal from the respective optical sensors 101, 102, and 103 is in ON status when the sensor is in the light input status, while the out signal is in OFF status when the sensor is in the light shielded status.

When the cam shaft 62 is rotated in a first direction by the driving of the stepping motor 63 from the status where the rotation angle of the light shielding plate 105 is 0° and the rotation angle of the light shielding plate 105 is changed from 0° to 316°, the statuses of the respective optical sensors 101, 102, and 103 change in order from the to of Table 1 to the bottom of the Table 1. On the other hand, when the cam shaft 62 is rotated in a second direction by the driving of the stepping motor 63 from the status where the rotation angle of the light shielding plate 105 is 316° and the rotation angle of the light shielding plate 105 is changed from 316° to 0°, the statuses of the respective optical sensors 101, 102, and 103 change in order from the bottom of Table 1 to the top of Table 1, i.e., in the order from the lower part of the Table 1 toward the upper part.

Note that in the Table 1, as the press-fixed status between the fixing roller 41 and the pressure roller 42, the three press-fixed statuses, the "first press-fixed" status, the "second press-fixed" status, and the "third press-fixed" status are given, however, the press-fixed status is not limited to these statuses. For example, a press-fixed status where the pressurizing force of the pressure roller 42 to the fixing roller 41 is smaller than the "first press-fixed" status (hereinbelow, referred to as "slight press-fixing" status) may be provided. The "slight press-fixing" status can be utilized when the temperature of the pressure roller 42 is controlled by transferring the heat of the fixing roller 41, which functions as a heating roller, to the pressure roller 42. Further, the "slight press-fixing" status can be utilized upon execution of processing to smooth the surface of the fixing roller 41 by friction between the fixing roller 41 and the pressure roller 42 caused by making a relative difference between the rotation speeds of the fixing roller 41 and the pressure roller 42, i.e., roller refresh processing. Further, although not shown, in a fixing apparatus where a fixing belt is put around a fixing roller, the "slight press-fixing" status can be utilized upon execution of processing to smooth the surface of the fixing belt by friction caused between the pressure roller and the fixing belt, i.e., belt refresh processing.

FIG. 16 to FIG. 21 show specific examples of the placement status of the respective optical sensors 101, 102, and 103 and the light shielding plate 105 obtained in the middle of rotation of the cam shaft 62 and the light shielding plate 105, from the placement status shown in FIG. 15, in the first direction. Hereinbelow, the respective specific examples will be described.

First, the placement status shown in FIG. 15 is obtained when the rotation angle of the light shielding plate 105 is 0°, i.e., when the "press-fixed/released status" between the fixing roller 41 and the pressure roller 42 is "released". In this placement status, the optical sensor 101 and the optical sensor 102 are respectively made in the "light shielded" status with the light shielding plate 105, and only the optical sensor 103 is in the "light input" status.

Figure 16:
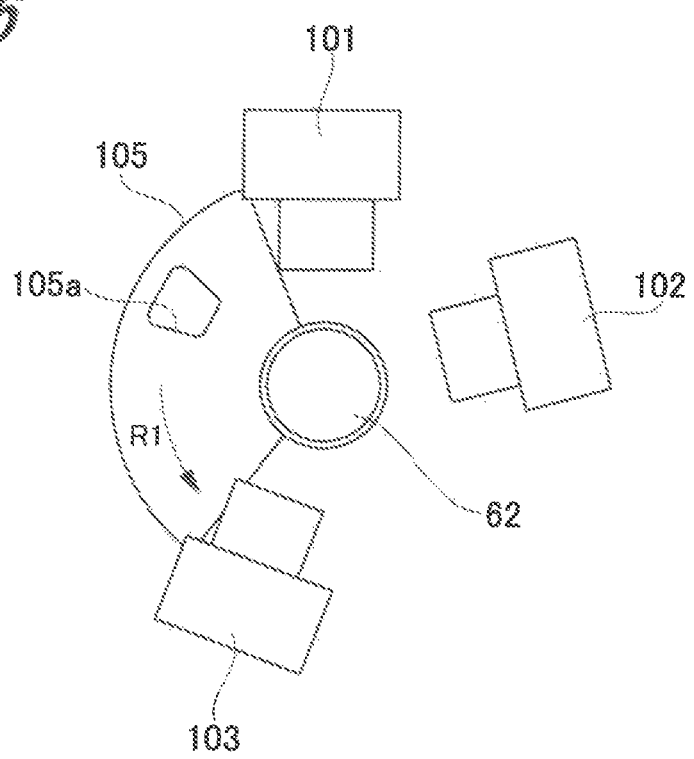
FIG. 16 is a schematic diagram showing a first specific example of a placement status of the respective optical sensors and a light shielding plate obtained by rotation of the cam shaft.

The placement status shown in FIG. 16 is obtained in the middle of the change of the "press-fixed/released status" between the fixing roller 41 and the pressure roller 42 from the "released" status to the "first press-fixed" status when the light shielding plate 105 is rotated from the status in FIG. 15 in the first direction R1. In the placement status, all the optical sensors 101, 102, and 103 are in the "light input" status.

Figure 17:
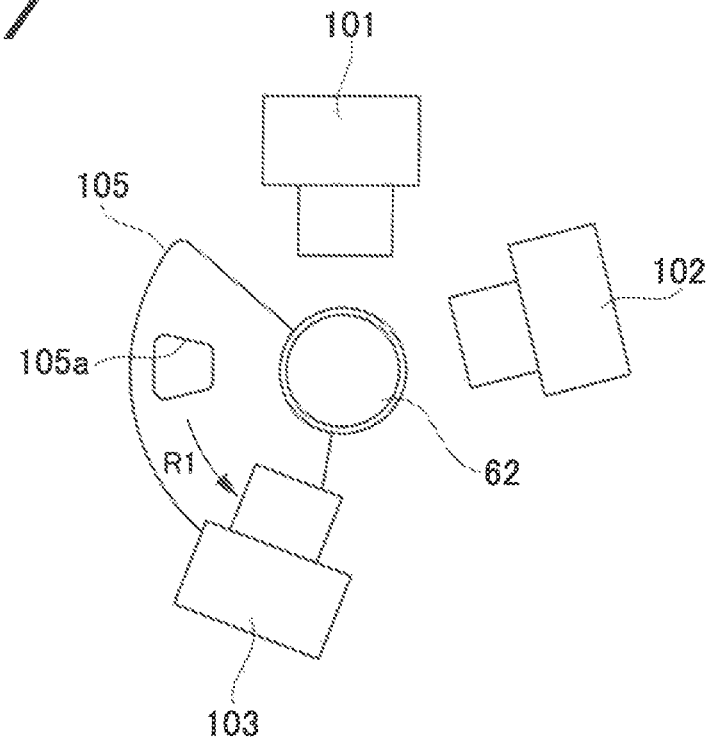
FIG. 17 is a schematic diagram showing a second specific example of the placement status of the respective optical sensors and the light shielding plate obtained by rotation of the cam shaft.

The placement status shown in FIG. 17 is obtained when the light shielding plate 105 is rotated from the status in FIG. 16 in the first direction R1 and the rotation angle of the light shielding plate 105 is 130°, i.e., the "press-fixed/released status" between the fixing roller 41 and the pressure roller 42 is the "first press-fixed" status. In this placement status, the optical sensor 101 and the optical sensor 102 are in the "light input" status, and only the optical sensor 103 is in the "light shielded" status with the light shielding plate 105.

Figure 18:
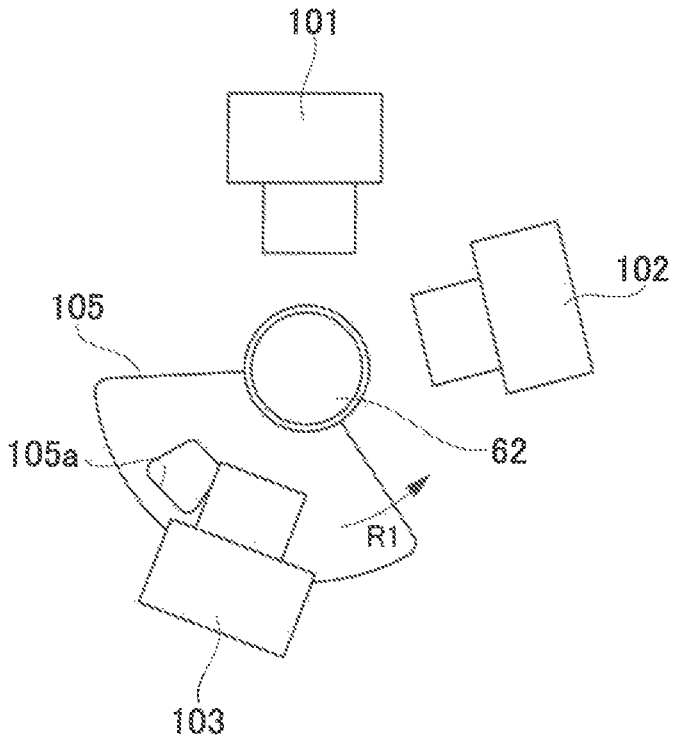
FIG. 18 is a schematic diagram showing a third specific example of the placement status of the respective optical sensors and the light shielding plate obtained by rotation of the cam shaft.

The placement status shown in FIG. 18 is obtained in the middle of the change of the "press-fixed/released status" between the fixing roller 41 and the pressure roller 42 from the "first press-fixed" status to the "second press-fixed" status when the light shielding plate 105 is rotated from the status in FIG. 17 in the first direction R1. In this placement status, the optical sensor 101 and the optical sensor 102 are in the "light input" status, and only the optical sensor 103 is in the "light shielded" status with the light shielding plate 105.

Figure 19:
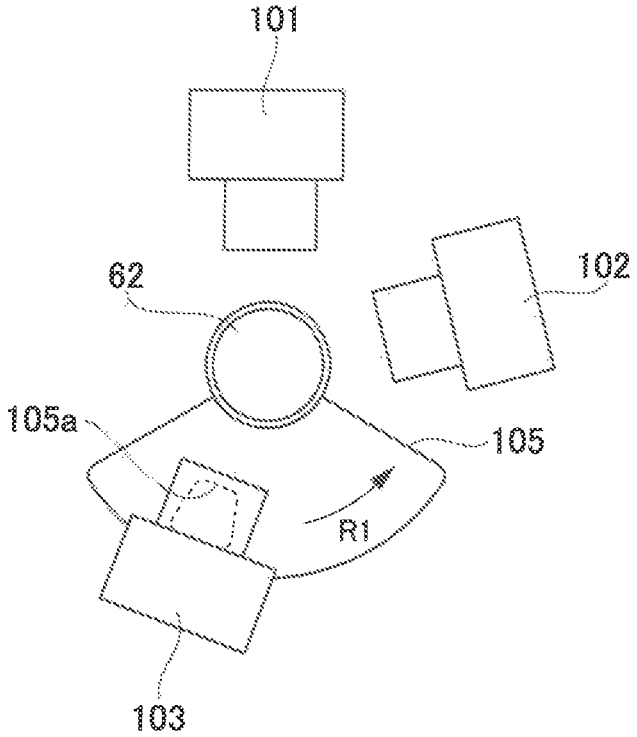
FIG. 19 is a schematic diagram showing a fourth specific example of the placement status of the respective optical sensors and the light shielding plate obtained by rotation of the cam shaft.

The placement status shown in FIG. 19 is obtained when the light shielding plate 105 is rotated from the status in FIG. 18 in the first direction R1 and the rotation angle of the light shielding plate 105 is 194°, i.e., the "press-fixed/released status" between the fixing roller 41 and the pressure roller 42 is the "second press-fixed" status. In this placement status, the optical sensor 101 and the optical sensor 103 are in the "light input" status, and the optical sensor 102 is also in the "light input" status with the existence of the hole 105*a* of the light shielding plate 105.

Figure 20:
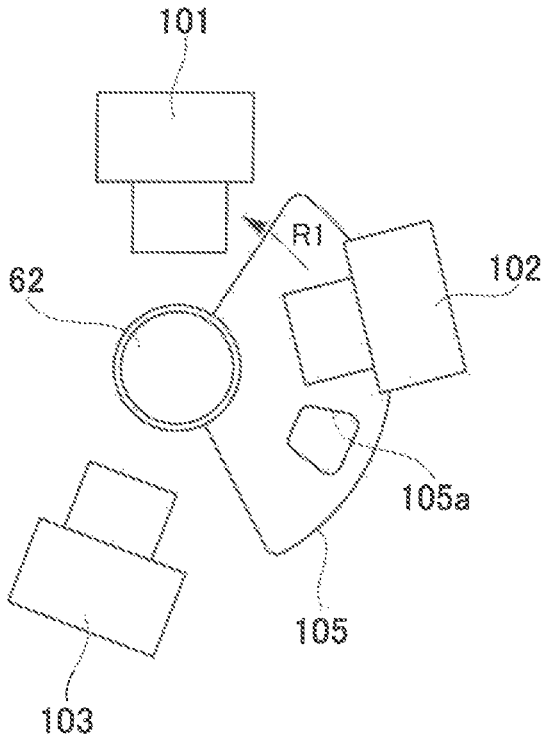
FIG. 20 is a schematic diagram showing a fifth specific example of the placement status of the respective optical sensors and the light shielding plate obtained by rotation of the cam shaft.

The placement status shown in FIG. 20 is obtained in the middle of the change of the "press-fixed/released status" between the fixing roller 41 and the pressure roller 42 from the "second press-fixed" status to the "third press-fixed" status when the light shielding plate 105 is rotated from the status in FIG. 19 in the first direction R1. In this placement status, the optical sensor 101 and the optical sensor 103 are in the "light input" status, and only the optical sensor 102 is in the "light shielded" status with the light shielding plate 105.

Figure 21:
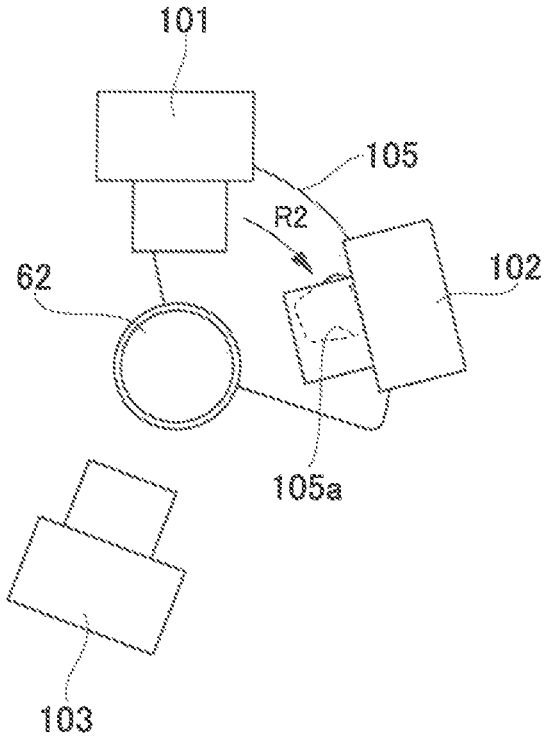
FIG. 21 is a schematic diagram showing a sixth specific example of the placement status of the respective optical sensors and the light shielding plate obtained by rotation of the cam shaft.

The placement status shown in FIG. 21 is obtained when the light shielding plate 105 is rotated from the status in FIG. 20 in the first direction R1 and the rotation angle of the light shielding plate 105 is 316°, i.e., the "press-fixed/released status" between the fixing roller 41 and the pressure roller 42 is the "third press-fixed" status. In this placement status, the optical sensor 101 is in the "light shielded" status with the light shielding plate 105, the optical sensor 102 is in the "light input" status with the existence of the hole 105*a* of the light shielding plate 105, and the optical sensor 103 is also in the "light input" status.

Note that when the light shielding plate 105 is rotated from the status in FIG. 21 in a second direction R2, the placement status of the respective optical sensors 101, 102, and 103 and the light shielding plate 105 changes in the order opposite to the above-described order.

Figure 22:
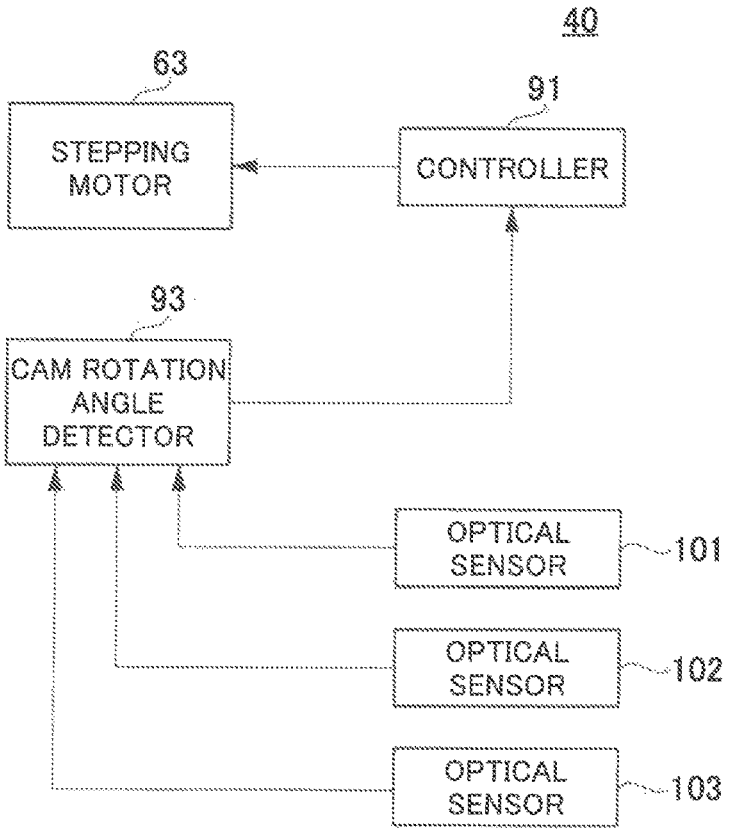
FIG. 22 is a block diagram showing the configuration of the control system of the fixing apparatus according to the second embodiment of the present invention.

FIG. 22 is a block diagram showing the configuration of the control system of the fixing apparatus according to the second embodiment of the present invention.

As shown in FIG. 22, the optical sensors 101, 102, and 103 are electrically connected to the cam rotation angle detector 93. The optical sensor 101 outputs a sensor signal which differs in accordance with whether the sensor itself is in the "light input" status or the "light shielded" status, to the cam rotation angle detector 93. More specifically, the optical sensor 101 outputs an ON signal when it is in the "light input" status, while outputs an OFF signal when it is in the "light shielded" status. Regarding this point, the sensor signal is outputted from the other optical sensors 102 and 103 as in the case of the optical sensor 101.

The cam rotation angle detector 93 detects the rotation angle of the pressure cam 61 based on the output signals from the respective optical sensors 101, 102, and 103. As described above, the rotation angle of the pressure cam 61 corresponds to the rotation angle of the light shielding plate 105. When the status changes of the respective optical sensors 101, 102, and 103 (the light input status and the light shielded status) are replaced with changes of the output signals from the respective optical sensors 101, 102, and 103, and previously set (stored) in the cam rotation angle detector 93, upon actual rotation of the pressure cam 61, it is possible to detect the rotation angle of the pressure cam 61 by the order of changes of the output signals from the respective optical sensors 101, 102, and 103.

In this manner, by providing the optical sensors 101, 102, and 103 around the axis of the cam shaft 62 and detecting the rotation angle of the pressure cam 61 based on the output signals from the optical sensors 101, 102, and 103, it is possible to detect the attitude of the pressure cam 61 with a simple configuration.

Note that in the second embodiment, the multiple (three) optical sensors 101, 102, and 103 are provided around the axis of the cam shaft 62, however, the present invention is not limited to this example. For example, it may be configured such that one optical sensor is provided around the axis of the cam shaft 62, and the rotation angle of the pressure cam 61 is detected based on the output signal from the optical sensor. Note that when multiple optical sensors are provided around the axis of the cam shaft 62, the transition state of the attitude of the pressure cam 61 in accordance with the rotation of the cam shaft 62 can be finely detected, accordingly, the configuration with multiple optical sensors provided around the axis of the cam shaft 62 is more preferable.

Third Embodiment

Next, a third embodiment of the present invention will be described. In comparison with the above-described first embodiment and second embodiment, the third embodiment differs in the configuration to detect the rotation angle of the pressure cam 61. Note that in the third embodiment, the constituent elements similar to or corresponding to the constituent elements given in the above-described first embodiment and second embodiment will have the same reference numerals, and overlapped contents will be omitted.

Figure 23:
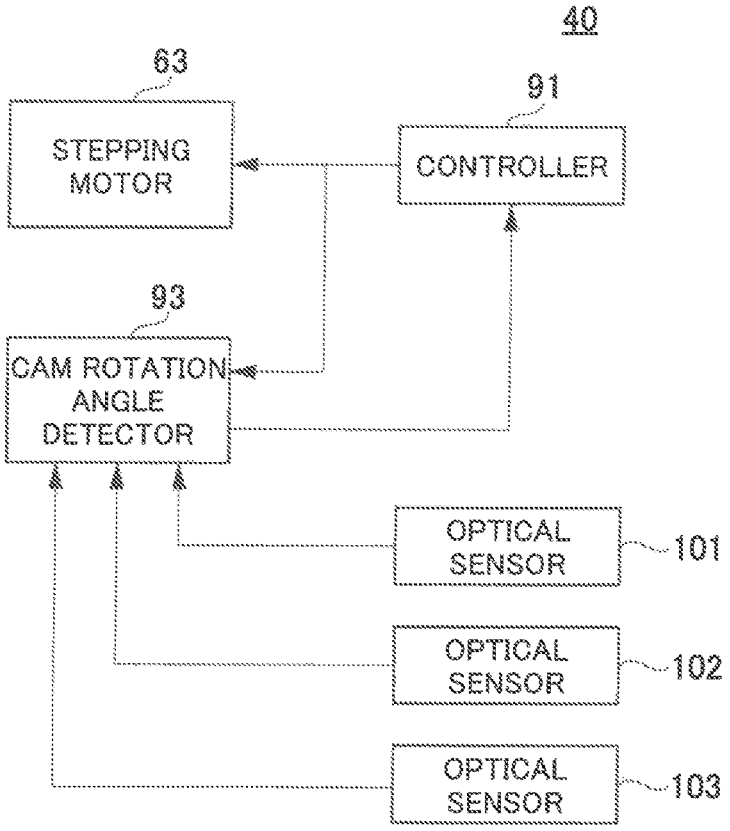
FIG. 23 is a block diagram showing the configuration of the control system of the fixing apparatus according to a third embodiment of the present invention.

FIG. 23 is a block diagram showing the configuration of the control system of the fixing apparatus according to the third embodiment of the present invention.

In FIG. 23, the cam rotation angle detector 93 detects the rotation angle of the pressure cam 61 based on the input pulse supplied from the controller 91 to the stepping motor 63 and the output signals from the respective optical sensors 101, 102, and 103. In the above-described first embodiment, to detect the rotation angle of the pressure cam 61, the input pulse to the stepping motor 63 is utilized. When the stepping motor 63 is overloaded due to some reason and the stepping motor 63 goes out of step, the rotation of the steeping motor 63 is not synchronized to the input pulse. In this case, it is not possible to accurately detect the rotation angle of the pressure cam 61. On the other hand, in the above-described second embodiment, to detect the rotation angle of the pressure cam 61, the output signals from the respective optical sensors 101, 102, and 103 are utilized. To finely detect the rotation angle of the pressure cam 61, it is necessary to provide a large number of optical sensors around the axis of the cam shaft 62.

In the third embodiment of the present invention, the rotation angle of the pressure cam 61 is detect by using both the input pulse supplied to the stepping motor 63 and the output signals from the respective optical sensors 101, 102, and 103. With this configuration, it is possible to detect step-out of the stepping motor 63. Further, it is possible to finely detect the rotation angle of the pressure cam 61 without providing a large number of optical sensors around the axis of the cam shaft 62. Hereinbelow, the configuration will be described in detail.

When the rotation angle of the pressure cam 61 is changed from 0° to 130° and the stepping motor 63 goes out of step in the middle of the change, the statuses of the respective optical sensors 101, 102, and 103 do not change from some statuses to the other statuses even though the input pulse is supplied to the stepping motor 63. In this case, the statuses of the output signals inputted from the respective optical sensors 101, 102, and 103 to the cam rotation angle detector 93 (ON/OFF statuses) are fixed to some statuses. In the cam rotation angle detector 93, when the number of input pulses supplied to the stepping motor 63 exceeds a predetermined number of pulses while the statuses of the output signals inputted from the respective optical sensors 101, 102, and 103 are fixed to some statuses, it is determined that out of step has occurred to the stepping motor 63. The predetermined number of pulses is set to a necessary number of pulses to change the statuses of the respective optical sensors 101, 102, and 103 from some statuses to the other statuses. With this configuration, in the cam rotation angle detector 93, it is possible to detect the out of step in the stepping motor 63.

Further, when the rotation angle of the pressure cam 61 is changed within the range from 0° to 316°, the statuses of the respective optical sensors 101, 102, and 103 change in correspondence with the rotation angle of the light shielding plate 105 as shown in the above-described Table 1. In the cam rotation angle detector 93, it is possible to detect that the statuses of the respective optical sensors 101, 102, and 103 have changed from some statuses to the other statuses due to the rotation of the pressure cam 61 based on the output signals from the respective optical sensors 101, 102, and 103. Further, in the cam rotation angle detector 93, by counting the number of input pulses supplied to the stepping motor 63 within the period where the statuses of the respective optical sensors 101, 102, and 103 change from some statuses to other statuses, it is possible to detect the rotation angle of the pressure cam 61 in the period. With this configuration, it is possible to finely and accurately detect the rotation angle of the pressure cam 61 without providing a large number of optical sensors around the axis of the cam shaft 62.

Note that the technical scope of the present invention is not limited to the above-described embodiments, but within a range to derive specific advantages with the constituent elements of the invention and combinations of the elements, includes forms with various changes and improvements. Further, the above-described embodiments can be implemented in appropriate combination unless technical contradiction or the like occurs.

Although embodiments of the present invention have been described and illustrated in detail, the disclosed embodiments are made for purposes of illustration and example only and not limitation. The scope of the present invention should be interpreted by terms of the appended claims.

LIST OF REFERENCE SIGNS

1 . . . image forming apparatus, 40 . . . fixing apparatus, 41 . . . fixing roller (fixing member), 42 . . . pressure roller (pressing member), 44 . . . fixing nip part, 45 . . . pressing mechanism, 61 . . . pressure cam, 62 . . . cam shaft, 63 . . . stepping motor, 64 . . . power transmission part, 64*a* . . . upstream-side power transmission mechanism, 78, 79 . . . spring (elastic member), 91 . . . controller, 93 . . . cam rotation angle detector, 101, 102, 103 . . . optical sensor, 611 . . . first cam surface region, 612 . . . second cam surface region, 613, 614 . . . cam flat part (third cam surface region), G3 . . . gear (worm), and G4 . . . gear (worm wheel).

What is claimed is:

1. A fixing apparatus comprising:

a fixing member and a pressing member; and a pressing mechanism that forms a fixing nip part by pressing the pressing member against the fixing member, wherein the pressing mechanism has:

a pressure cam to press the pressing member against the fixing member;

a camshaft that the pressure cam is attached to, and that is rotated integrally with the pressure cam;

a stepping motor; and a power transmission part that transmits a driving force of the stepping motor to the camshaft, wherein the power transmission part includes:

an upstream-side power transmission mechanism including a plurality of spur gears comprising at least a first spur gear that rotates integrally with a driving shaft of the stepping motor, and a second spur gear that engages with the first spur gear, a worm that is provided immediately downstream of the upstream-side power transmission mechanism on a power transmission path from the stepping motor to the camshaft, and that has a rotational axis parallel to rotational axes of the driving shaft of the stepping motor, the first spur gear, and the second spur gear, and a downstream-side power transmission mechanism arranged immediately downstream of the worm on the power transmission path, the downstream-side power transmission mechanism including a worm wheel that engages with the worm and that has a rotational axis orthogonal to the rotational axis of the worm, and a plurality of spur gears that transmit a rotation force of the worm wheel to the camshaft, whereby the worm transmits the driving force of the stepping motor from the upstream-side power transmission mechanism to the downstream-side power transmission mechanism, which in turn transmits the driving force to the camshaft.

2. The fixing apparatus according to claim 1, wherein the upstream-side power transmission mechanism is configured with a power transmission mechanism in which no force occurs in a thrust direction with respect to the driving shaft of the stepping motor.

3. The fixing apparatus according to claim 1, further comprising a cam rotation angle detector that detects a rotation angle of the pressure cam, wherein the cam rotation angle detector detects the rotation angle of the pressure cam based on an input pulse supplied to the stepping motor.

4. The fixing apparatus according to claim 1, further comprising a cam rotation angle detector that detects a rotation angle of the pressure cam, wherein the cam rotation angle detector detects the rotation angle of the pressure cam based on an output signal from an optical sensor provided around the axis of the camshaft so as to change ON/OFF status in accordance with rotation of the camshaft.

5. The fixing apparatus according to claim 4, wherein the optical sensor is provided in a plurality of positions around the axis of the camshaft.

6. The fixing apparatus according to claim 1, further comprising a cam rotation angle detector that detects a rotation angle of the pressure cam, wherein the cam rotation angle detector detects the rotation angle of the pressure cam based on an input pulse supplied to the stepping motor and an output signal from an optical sensor provided around the axis of the camshaft so as to change ON/OFF status in accordance with rotation of the camshaft.

7. The fixing apparatus according to claim 1, further comprising a controller that controls rotation of the pressure cam, wherein the controller controls the rotation of the pressure cam, with one of a top dead center and a bottom dead center, previously set in a rotation direction of the pressure cam, as a starting point.

8. The fixing apparatus according to claim 1, further comprising a controller that controls rotation of the pressure cam, wherein the controller performs control to change a rotation angle of the pressure cam during a print job based on a predetermined condition.

9. The fixing apparatus according to claim 1, wherein the pressure cam has a first cam surface region and a second cam surface region, positioned in mutually different cam surface regions, in a rotation direction of the pressure cam, the first cam surface region is a cam surface region in which a distance from a rotation center of the pressure cam to the cam surface is changed more steeply than in the second cam surface region, and the second cam surface region is a cam surface region in which the distance from the rotation center of the pressure cam to the cam surface is changed more gently than in the first cam surface region.

10. The fixing apparatus according to claim 9, wherein the second cam surface region includes a third cam surface region in which the distance from the rotation center of the pressure cam to the cam surface is uniform.

11. The fixing apparatus according to claim 1, wherein the pressing mechanism has an elastic member that generates a pressurizing force to press the pressing member against the fixing member by rotation of the pressure cam, and the elastic member includes at least a first elastic member and a second elastic member having an elastic modulus different from the elastic modulus of the first elastic member.

12. An image forming apparatus comprising the fixing apparatus in claim 1.

* * * * *